US012043514B2

(12) United States Patent
Barnett et al.

(10) Patent No.: US 12,043,514 B2
(45) **Date of Patent: *Jul. 23, 2024**

(54) EXPANDABLE DRUM ASSEMBLY FOR DEPLOYING COILED PIPE AND METHOD OF USING SAME

(71) Applicant: Trinity Bay Equipment Holdings, LLC, Houston, TX (US)

(72) Inventors: Alexander Ryan Barnett, Houston, TX (US); Matthew Allen Hegler, Kingwood, TX (US)

(73) Assignee: Trinity Bay Equipment Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/328,860

(22) Filed: Jun. 5, 2023

(65) Prior Publication Data

US 2023/0322520 A1 Oct. 12, 2023

Related U.S. Application Data

(63) Continuation of application No. 17/374,574, filed on Jul. 13, 2021, now Pat. No. 11,667,492, which is a (Continued)

(51) Int. Cl.
*B65H 75/24* (2006.01)
*B65H 75/22* (2006.01)
(Continued)

(52) U.S. Cl.
CPC ..... *B65H 75/2437* (2021.05); *B65H 75/2209* (2021.05); *B65H 75/2245* (2021.05);
(Continued)

(58) Field of Classification Search
CPC ..... B65H 75/2209
See application file for complete search history.

(56) References Cited

U.S. PATENT DOCUMENTS 2,370,868 A 3/1945 Luebke
4,221,347 A 9/1980 Hill
(Continued)

FOREIGN PATENT DOCUMENTS

AU 2014299014 1/2019
AU 2014363465 1/2019
(Continued)

OTHER PUBLICATIONS

Egyptian Patent Office; Office Action, issued in connection to application No. PCT576/2019; 2021; 8 pages; Egypt.
(Continued)

*Primary Examiner* — William A. Rivera
(74) *Attorney, Agent, or Firm* — Greenberg Traurig, LLP; Dwayne Mason; Ira Hatton

(57) ABSTRACT

A drum assembly includes a support bar, expandable spokes extending away from the support bar, drum segments mounted to the expandable spokes, support brackets disposed on the support bar, a primary mechanical actuator extending between the support brackets, and secondary mechanical actuators extending from the support brackets.

20 Claims, 15 Drawing Sheets

Related U.S. Application Data continuation of application No. 16/340,307, filed as application No. PCT/US2017/055548 on Oct. 6, 2017, now Pat. No. 11,235,946.

(60) Provisional application No. 62/432,769, filed on Dec. 12, 2016, provisional application No. 62/406,239, filed on Oct. 10, 2016.

(51) Int. Cl.
*E21B 19/00* (2006.01)
*E21B 19/22* (2006.01)

(52) U.S. Cl.
CPC ..... *B65H 75/242* (2013.01); *E21B 19/008* (2013.01); *E21B 19/22* (2013.01); *B65H 2701/33* (2013.01)

(56) References Cited

U.S. PATENT DOCUMENTS

| | | | | |
|---|---|---|---|---|
| 6,345,781 | B1 | 2/2002 | Bowers | |
| 6,352,215 | B1 | 3/2002 | Cash et al. | |
| 8,985,496 | B2 | 3/2015 | Dillinger et al. | |
| 9,816,334 | B2 | 11/2017 | Wolf | B21C 47/24 |
| 10,190,722 | B2 | 1/2019 | Espinasse et al. | |
| 10,197,198 | B2 | 2/2019 | Glejbol | |
| 10,226,823 | B2 | 3/2019 | Showcor | |
| 10,226,892 | B2 | 3/2019 | Kremers et al. | |
| 10,234,068 | B2 | 3/2019 | Varagnolo et al. | |
| 10,281,065 | B2 | 5/2019 | Secher et al. | |
| 10,285,223 | B2 | 5/2019 | Hatton et al. | |
| 10,288,207 | B2 | 5/2019 | Littlestar et al. | |
| 10,378,682 | B2 | 8/2019 | Cloos et al. | |
| 10,408,795 | B2 | 9/2019 | Nicolas et al. | |
| 10,415,731 | B2 | 9/2019 | Boche et al. | |
| 10,429,267 | B2 | 10/2019 | Grimsley | |
| 10,436,667 | B2 | 10/2019 | Littlestar et al. | |
| 10,442,925 | B2 | 10/2019 | Rong et al. | |
| 10,451,206 | B2 | 10/2019 | Espinasse et al. | |
| 10,471,661 | B2 | 11/2019 | Boczkowski et al. | |
| 10,480,054 | B2 | 11/2019 | Valdez et al. | |
| 10,487,965 | B2 | 11/2019 | Bouey et al. | |
| 10,494,519 | B2 | 12/2019 | Wilson et al. | |
| 10,513,896 | B2 | 12/2019 | Gudme et al. | |
| 10,527,198 | B2 | 1/2020 | Nicolson et al. | |
| 10,544,889 | B2 | 1/2020 | Bouey et al. | |
| 10,544,892 | B2 | 1/2020 | Holst | |
| 10,822,194 | B1 | 11/2020 | Hegler | B65H 75/242 |
| 11,235,946 | B2 * | 2/2022 | Barnett | B65H 75/242 |
| 11,667,492 | B2 * | 6/2023 | Barnett | B65H 75/2437 242/576.1 |
| 2009/0152390 | A1 | 6/2009 | Underbrink et al. | |
| 2014/0191076 | A1 | 7/2014 | Dillinger | B65H 49/30 242/575 |
| 2019/0003921 | A1 | 1/2019 | Nicholas | |
| 2019/0024830 | A1 | 1/2019 | Glejbol | |
| 2019/0094101 | A1 | 3/2019 | Spiegel et al. | |
| 2019/0101233 | A1 | 4/2019 | Hatton et al. | |
| 2019/0126567 | A1 | 5/2019 | Bornemann et al. | |
| 2019/0154186 | A1 | 5/2019 | Varagnolo et al. | |
| 2019/0162334 | A1 | 5/2019 | Westhoff et al. | |
| 2019/0162335 | A1 | 5/2019 | Yu et al. | |
| 2019/0162336 | A1 | 5/2019 | Andersen et al. | |
| 2019/0186656 | A1 | 6/2019 | Kozak et al. | |
| 2019/0194440 | A1 | 6/2019 | Rong et al. | |
| 2019/0217337 | A1 | 7/2019 | Gujare et al. | |
| 2019/0219473 | A1 | 7/2019 | Littlestar et al. | |
| 2019/0242501 | A1 | 8/2019 | Bereczkne et al. | |
| 2019/0257448 | A1 | 8/2019 | Chalmers et al. | |
| 2019/0285199 | A1 | 9/2019 | Nicolson et al. | |
| 2019/0309582 | A1 | 10/2019 | Procida | |
| 2019/0338868 | A1 | 11/2019 | Hjorth | |
| 2019/0368967 | A1 | 12/2019 | Grimsley | |
| 2019/0391097 | A1 | 12/2019 | Nicolas et al. | |
| 2020/0011467 | A1 | 1/2020 | Holst | |
| 2020/0039781 | A1 | 2/2020 | Barnett | |

FOREIGN PATENT DOCUMENTS

| | | | |
|---|---|---|---|
| AU | 2017302735 | | 1/2019 |
| AU | 2014310509 | | 3/2019 |
| AU | 2017319390 | | 3/2019 |
| AU | 2017347152 | | 5/2019 |
| AU | 2017365730 | | 6/2019 |
| AU | 2018211384 | | 8/2019 |
| AU | 2018222217 | | 8/2019 |
| AU | 2015335367 | | 10/2019 |
| AU | 2015345613 | | 10/2019 |
| AU | 2018288000 | | 1/2020 |
| AU | 2019279941 | | 1/2020 |
| BR | 112014017998 | | 1/2019 |
| BR | 112018013586 | | 1/2019 |
| BR | PI0810573 | | 1/2019 |
| BR | PI0819542 | | 1/2019 |
| BR | 112019001414 | | 2/2019 |
| BR | 112018075840 | | 3/2019 |
| BR | 112019004048 | | 3/2019 |
| BR | PI0517181 | | 3/2019 |
| BR | 112019000076 | | 4/2019 |
| BR | 112019007789 | | 4/2019 |
| BR | PI0914836 | | 4/2019 |
| BR | 112019003669 | | 5/2019 |
| BR | 112019005154 | | 6/2019 |
| BR | 112013032388 | | 7/2019 |
| BR | 112019013850 | | 7/2019 |
| BR | PI0720487 | | 8/2019 |
| BR | 112012015257 | | 9/2019 |
| BR | 112013017957 | | 9/2019 |
| BR | 112015027495 | | 9/2019 |
| BR | 112016001932 | | 9/2019 |
| BR | PI0909348 | | 9/2019 |
| BR | 112015002088 | | 10/2019 |
| BR | 112019020051 | | 10/2019 |
| BR | 112012020776 | | 11/2019 |
| BR | 112019012614 | | 11/2019 |
| BR | PI0808956 | | 11/2019 |
| BR | 112013028806 | | 12/2019 |
| BR | 112013000428 | | 1/2020 |
| BR | 112019013850 | | 1/2020 |
| BR | PI0924891 | | 1/2020 |
| CA | 2859433 | | 3/2019 |
| CA | 2823056 | | 4/2019 |
| CA | 2765294 | | 6/2019 |
| CA | 2854955 | | 6/2019 |
| CA | 2835008 | | 8/2019 |
| CA | 3012146 | | 1/2020 |
| CN | 201494971 | | 6/2010 |
| CN | 205442258 | | 8/2016 |
| CN | 106477396 | | 3/2017 |
| CN | 109153196 | | 1/2019 |
| CN | 109153229 | | 1/2019 |
| CN | 109958827 | | 7/2019 |
| CN | 110023220 | | 7/2019 |
| CN | 110177969 | | 8/2019 |
| CN | 106985493 | | 11/2019 |
| CN | 108291686 | | 11/2019 |
| CN | 110461586 | | 11/2019 |
| CN | 110462273 | | 11/2019 |
| CN | 107250643 | | 12/2019 |
| CN | 108291670 | | 1/2020 |
| DE | 102018214615 | | 6/2019 |
| DK | 3224393 | T3 | 1/2019 |
| DK | 2820083 | T3 | 2/2019 |
| DK | 2959199 | T5 | 2/2019 |
| DK | 3228639 | T3 | 2/2019 |
| DK | 2780159 | T3 | 4/2019 |
| DK | 3196523 | T3 | 4/2019 |
| DK | 2516534 | | 7/2019 |
| DK | 2901062 | T3 | 8/2019 |
| DK | 3286474 | T3 | 9/2019 |
| EP | 2360406 | | 1/2019 |
| EP | 2780159 | | 1/2019 |

(56) References Cited

FOREIGN PATENT DOCUMENTS

| | | | |
|---|---|---|---|
| EP | 3069063 | | 1/2019 |
| EP | 3433523 | | 1/2019 |
| EP | 3089846 | | 2/2019 |
| EP | 3334969 | | 2/2019 |
| EP | 3334970 | | 2/2019 |
| EP | 3439871 | | 2/2019 |
| EP | 2386894 | | 3/2019 |
| EP | 2516534 | | 3/2019 |
| EP | 2737238 | | 3/2019 |
| EP | 2859173 | | 3/2019 |
| EP | 3371502 | | 3/2019 |
| EP | 3455059 | | 3/2019 |
| EP | 3455536 | | 3/2019 |
| EP | 3458531 | | 3/2019 |
| EP | 2862700 | | 4/2019 |
| EP | 3105484 | | 4/2019 |
| EP | 3258155 | | 4/2019 |
| EP | 3334965 | | 4/2019 |
| EP | 3334967 | | 4/2019 |
| EP | 3463849 | | 4/2019 |
| EP | 3468725 | | 4/2019 |
| EP | 3314155 | | 5/2019 |
| EP | 3488135 | | 5/2019 |
| EP | 2519764 | | 6/2019 |
| EP | 2572134 | | 7/2019 |
| EP | 2661578 | | 7/2019 |
| EP | 3507535 | | 7/2019 |
| EP | 3513108 | | 7/2019 |
| EP | 2576333 | | 8/2019 |
| EP | 3014157 | | 8/2019 |
| EP | 3059481 | | 8/2019 |
| EP | 3523232 | | 8/2019 |
| EP | 3526437 | | 8/2019 |
| EP | 2588787 | | 9/2019 |
| EP | 2870397 | | 9/2019 |
| EP | 3093546 | | 10/2019 |
| EP | 3548280 | | 10/2019 |
| EP | 3350498 | | 12/2019 |
| EP | 3482112 | | 12/2019 |
| EP | 3583344 | | 12/2019 |
| FR | 3068104 | | 7/2019 |
| FR | 3077997 | | 8/2019 |
| FR | 3074251 | | 12/2019 |
| FR | 3076337 | | 1/2020 |
| GB | 2503880 | | 3/2019 |
| GB | 2562674 | | 3/2019 |
| GB | 2557571 | | 9/2019 |
| GB | 2572120 | | 9/2019 |
| GB | 2520756 | | 10/2019 |
| GB | 2535925 | | 12/2019 |
| GB | 2574296 | | 12/2019 |
| HU | E045956 | T2 | 1/2020 |
| IN | 330637 | | 1/2020 |
| JP | 5159158 | | 12/2012 |
| PL | 2678216 | T3 | 2/2019 |
| PL | 2379299 | T3 | 5/2019 |
| RU | 2018113428 | | 10/2019 |
| WO | 2002/034647 | | 5/2002 |
| WO | 2015/011462 | | 1/2015 |
| WO | 2018/071299 | | 4/2018 |
| WO | 2019/016554 | | 1/2019 |
| WO | 2019/016558 | | 1/2019 |
| WO | 2019/073047 | | 4/2019 |
| WO | 2019/022599 | | 5/2019 |
| WO | 2019/099219 | | 5/2019 |
| WO | 2019/105926 | | 6/2019 |
| WO | 2019/112431 | | 6/2019 |
| WO | 2019/120677 | | 6/2019 |
| WO | 2019/141326 | | 7/2019 |
| WO | 2019/165562 | | 9/2019 |
| WO | 2019/197538 | | 10/2019 |
| WO | 2019/207031 | | 10/2019 |
| WO | 2019/238456 | | 12/2019 |
| WO | 2020/016325 | | 1/2020 |

OTHER PUBLICATIONS

National Institute of Industrial Property of Argentina; Office Action, issued in connection to application No. P170102828; Sep. 13, 2021; 5 pages; Argentina.

Mexican Institute of Industrial Property; Office Action, issued in conneciton to application No. MX/a/2019/004058; Aug. 30, 2021; 6 pages; Mexico.

Saudi Authority for Intellectual Property; Examination Report, issued in connection to application No. 519401502; Jun. 13, 2021; 6 pages; Saudi Arabia.

The International Bureau of WIPO, PCT International Preliminary Report on Patentability, issued in connection to PCT/US17/55548; Apr. 25, 2019; 8 pages; Switzerland.

United States Patent and Trademark Office; PCT International Search Report, issued in connection to PCT/US17/55548; Dec. 11, 2017; 2 pages; US.

United States Patent and Trademark Office; PCT Written Opinion of the International Searching Authority, issued in connection to PCT/US17/55548; Dec. 11, 2017; 6 pages; US.

Pakistan Patent Office; Examination Report, issued in connection to application No. 520/2017; Aug. 2019; 1 page; Pakistan.

Eurasian Patent Office; Office Action, issued in connection to application No. 201990925; 7 pages; Apr. 13, 2020; Russia.

China National Intellectual Property Administration; First Office Action, issued in connection to application No. 2017800727982; Apr. 1, 2020; 10 pages; China.

European Patent Office; Extended European Search Report, issued in connection application No. EP17860435.1; Apr. 8, 2020; 8 pages; Europe.

European Patent Office; Communication pursuant to Rules 70(2) and 70a(2) EPC, issued in connection application No. EP17860435.1; Apr. 20, 2020; 9 pages; Europe.

Indonesia Patent Office; Substantive Examination Report, issued in connection to application No. PID201903431; Jan. 28, 2021; 4 pages; Indonesia.

República De Colombia Superintendencia De Industria Y Comercio; Final Rejection Resolution Report of the Divisional Application, issued in connection to application No. NC2020/0000269; Mar. 23, 2021; 27 pages; Colombia.

National Institute of Industrial Property of Argentina; Office Action, issued in connection to application No. 20170102828; May 6, 2021; Argentina.

Intellectual Property of India; Office Action, issued in conenction to application No. 201917017437; Mar. 1, 2021; 10 pages; India.

* cited by examiner

EXPANDABLE DRUM ASSEMBLY FOR DEPLOYING COILED PIPE AND METHOD OF USING SAME

CROSS-REFERENCE TO RELATED APPLICATIONS

This application claims priority to and benefit of U.S. patent application Ser. No. 17/374,574, entitled "EXPANDABLE DRUM ASSEMBLY FOR DEPLOYING COILED PIPE AND METHOD OF USING SAME" and filed Jul. 13, 2021, which claims priority to and benefit of U.S. patent application Ser. No. 16/340,307, entitled "EXPANDABLE DRUM ASSEMBLY FOR DEPLOYING COILED PIPE AND METHOD OF USING SAME," filed Apr. 8, 2019, and now U.S. Pat. No. 11,235,946, which claims priority to and benefit of PCT Application No. PCT/US2017/055548, filed Oct. 6, 2017, which claims priority to and benefit of U.S. Provisional Application 62/406,239, filed Oct. 10, 2016, as well as U.S. Provisional Application 62/432,769, filed Dec. 12, 2016, which are each incorporated herein in its entirety for all purposes.

BACKGROUND

Flexible pipe is useful in a myriad of environments, including in the oil and gas industry. Flexible pipe may be durable and operational in harsh operating conditions and can accommodate high pressures and temperatures. Flexible pipe may be bundled and arranged into one or more coils to facilitate transporting and using the pipe.

Coils of pipe may be positioned in an "eye to the side" or "eye to the sky" orientation. When the flexible pipe is coiled and is disposed with its interior channel facing upwards, such that the coil is in a horizontal orientation, then the coils of pipe are referred to as being in an "eye to the sky" orientation. If, instead, the flexible pipe is coiled and disposed such that the interior channel is not facing upwards, such that the coil is in an upright or vertical orientation, then the coils of pipe are referred to as being in an "eye to the side" orientation.

The flexible pipe may be transported as coils to various sites for deployment (also referred to as uncoiling or unspooling). Different types of devices and vehicles are currently used for loading and transporting coils of pipe, but usually extra equipment and human manual labor is also involved in the process of loading or unloading such coils for transportation and/or deployment. Such coils of pipe are often quite large and heavy. Accordingly, there exists a need for an improved method and apparatus for loading and unloading coils of pipe.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments of the present disclosure relate to a drum assembly that includes a support bar having a first end and a second end and a first plurality of expandable spokes extending away from the first end of the support bar. A distal end of each of the first plurality of expandable spokes is movable between a retracted position and an extended position. The drum assembly also includes a second plurality of expandable spokes extending away from the second end of the support bar. A distal end of each of the second plurality of expandable spokes is movable between a retracted position and an extended position. The drum assembly also includes a plurality of drum segments each mounted to the distal end of one of the first plurality of expandable spokes and the distal end of one of the second plurality of expandable spokes. Each of the plurality of drum segments extends parallel to the support bar. The drum assembly also includes a first support bracket disposed on the support bar proximate the first end of the support bar and moveable along a first longitudinal section of the support bar, a second support bracket disposed on the support bar proximate the second end of the support bar and moveable along a second longitudinal section of the support bar, and a primary mechanical actuator extending between the first support bracket and the second support bracket. The primary mechanical actuator is capable of moving at least one of the first support bracket, the second support bracket, or both. The drum assembly also includes a first plurality of secondary mechanical actuators each extending between the first support bracket and one of the first plurality of expandable spokes or one of the plurality of drum segments. The first plurality of secondary mechanical actuators are capable of moving the location of the first plurality of expandable spokes between the retracted and extended positions. The drum assembly also includes a second plurality of secondary mechanical actuators each extending between the second support bracket and one of the second plurality of expandable spokes or one of the plurality of drum segments. The second plurality of secondary mechanical actuators is capable of moving the location of the second plurality of expandable spokes between the retracted and extended positions.

In another aspect, embodiments of the present disclosure relate to a method of engaging a drum assembly with a coil of flexible pipe that includes disposing the drum assembly within an interior region of the coil of flexible pipe. The drum assembly includes a support bar having a first end and a second end and a first plurality of expandable spokes extending away from the first end of the support bar. A distal end of each of the first plurality of expandable spokes is movable between a retracted position and an extended position. The drum assembly also includes a second plurality of expandable spokes extending away from the second end of the support bar. A distal end of each of the second plurality of expandable spokes is movable between a retracted position and an extended position. The drum assembly also includes a plurality of drum segments each mounted to the distal end of one of the first plurality of expandable spokes and the distal end of one of the second plurality of expandable spokes. Each of the plurality of drum segments extends parallel to the support bar. The drum assembly also includes a first support bracket disposed on the support bar proximate the first end of the support bar and moveable along a first longitudinal section of the support bar, a second support bracket disposed on the support bar proximate the second end of the support bar and moveable along a second longitudinal section of the support bar, and a primary mechanical actuator extending between the first support bracket and the second support bracket. The primary mechanical actuator is capable of moving at least one of the first support bracket, the second support bracket, or both. The drum assembly also includes a first plurality of secondary mechanical actuators each extending between the first support bracket and one of the first plurality of expandable spokes or one of the plurality of drum segments. The first plurality of secondary mechanical actuators are capable of moving the location of the first plurality of expandable spokes between the retracted and extended positions. The drum assembly also includes a second plurality of secondary mechanical actuators each extending between the second support bracket and one of the second plurality of expandable spokes or one of the plurality of drum segments. The second plurality of secondary mechanical actuators is capable of moving the location of the second plurality of expandable spokes between the retracted and extended positions. The method also includes moving the first plurality of expandable spokes and the second plurality of expandable spokes from the retracted position to the extended position using at least one of the primary mechanical actuator, the first plurality of secondary mechanical actuators, the second plurality of secondary mechanical actuators, or any combination thereof, and contacting the coil of flexible pipe with at least two of the plurality of drum segments such that the drum assembly is secured within the interior region of the coil of flexible pipe.

Other aspects and advantages of the claimed subject matter will be apparent from the following description and the appended claims.

DETAILED DESCRIPTION

Figure 1:
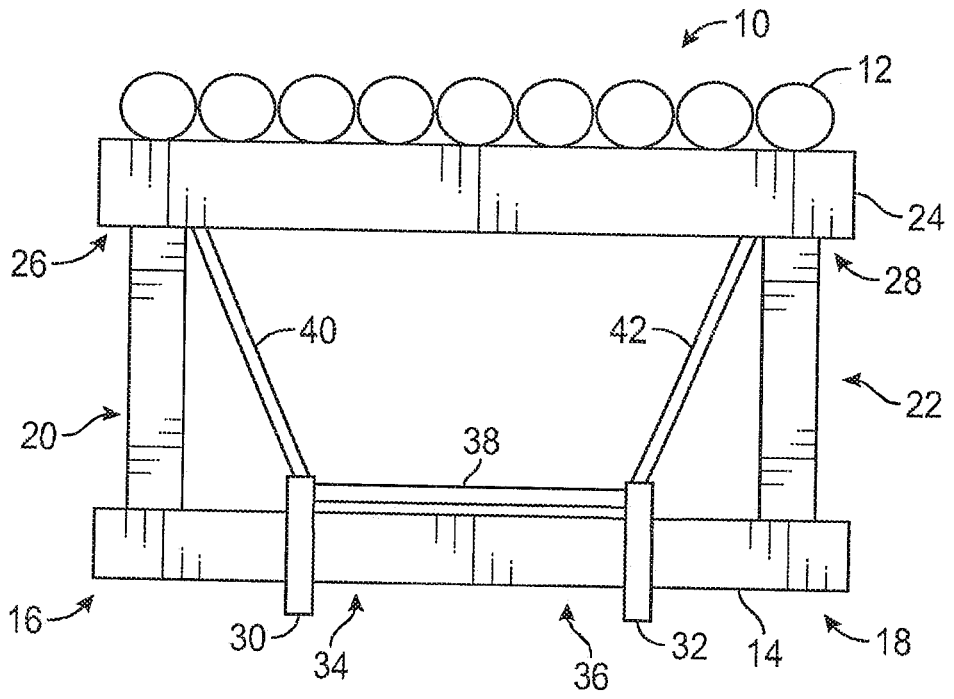
FIG. 1 is a diagram of a drum assembly according to embodiments of the present disclosure.

Embodiments of the present disclosure relate generally to systems used for deploying coils of flexible pipe. The coils of pipe may be self-supported, for example, using bands to hold coils together. Coil handling drum assemblies according to embodiments of the present disclosure may include a support bar, expandable spokes extending away from the support bar, drum segments mounted to the expandable spokes, support brackets disposed on the support bar, a primary mechanical actuator extending between the support brackets, and secondary mechanical actuators extending from the support brackets.

Embodiments of the present disclosure will be described below with reference to the figures. In one aspect, embodiments disclosed herein relate to embodiments for handling coils using expandable drum assemblies.

As used herein, the term "coupled" or "coupled to" may indicate establishing either a direct or indirect connection, and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

FIG. 1 illustrates a block diagram of an embodiment of a drum assembly 10. As described in detail below, spoolable pipe 12 may be disposed about the drum assembly 10 to enable handling of the spoolable pipe 12. Spoolable pipe 12 may refer to any type of flexible pipe or piping capable of being bent into a coil. Such coils of spoolable pipe 12 may reduce the amount of space taken up by pipe during manufacturing, shipping, transportation, and deployment compared to rigid pipe that is not capable of being bent into a coil.

Pipe, as understood by those of ordinary skill, may be a tube to convey or transfer any water, gas, oil, or any type of fluid known to those skilled in the art. The spoolable pipe 12 may be made of any type of materials including without limitation plastics, metals, a combination thereof, composites (e.g., fiber reinforced composites), or other materials known in the art. The flexible pipe of the spoolable pipe 12 is used frequently in many applications, including without limitation, both onshore and offshore oil and gas applications. Flexible pipe may include Flexible Composite Pipe (FCP) or Reinforced Thermoplastic Pipe (RTP). A FCP or RTP pipe may itself be generally composed of several layers. In one or more embodiments, a flexible pipe may include a high-density polyethylene ("HDPE") pipe having a reinforcement layer and an HDPE outer cover layer. Thus, flexible pipe may include different layers that may be made of a variety of materials and also may be treated for corrosion resistance. For example, in one or more embodiments, pipe used to make up a coil of pipe may have a corrosion protection shield layer that is disposed over another layer of steel reinforcement. In this steel-reinforced layer, helically wound steel strips may be placed over a liner made of thermoplastic pipe. Flexible pipe may be designed to handle a variety of pressures. Further, flexible pipe may offer unique features and benefits versus steel/carbon steel pipe lines in the area of corrosion resistance, flexibility, installation speed and re-usability.

The drum assembly 10 of FIG. 1 also includes a support bar 14 having a first end 16 and a second end 18. The support bar 14 is used to handle the drum assembly 10 and various components are coupled to the support bar 14, as described in further detail below. In certain embodiments, a first plurality of expandable spokes 20 are coupled to the support bar 14 proximate the first end 16 and a second plurality of expandable spokes 22 are coupled to the support bar 14 proximate the second end 18. In addition, each of a plurality of drum segments 24 are mounted to a distal end 26 of one of the first plurality of expandable spokes 20 and a distal end 28 of one of the second plurality of expandable spokes 22. The drum segments 24 extend parallel to the support bar 14. For clarity, only one expandable spoke 20, one expandable spoke 22, and one drum segment 24 are shown in FIG. 1. The plurality of drum segments 24 are used to support the spoolable pipe 12 and the distal ends 26 and 28 of the first and second pluralities of expandable spokes 20 and 22 are movable between retracted and extended positions, as described in more detail below. Thus, the drum assembly 10 is configured to be easily inserted and withdrawn from coils of spoolable pipe 12 and to be used with coils of spoolable pipe 12 of different inner diameters.

The drum assembly 10 also includes a first support bracket 30 disposed on the support bar 14 near the first end 16 and a second support bracket 32 disposed on the support bar 14 near the second end 18. The first support bracket 30 is moveable along a first longitudinal section 34 of the support bar 14 and the second support bracket 32 is moveable along a second longitudinal section 36 of the support bar 14. A primary mechanical actuator 38 may extend between the first support bracket 30 and the second support bracket 32. The primary mechanical actuator 38 may be used to move the first support bracket 30, the second support bracket 32, or both brackets 30 and 32. A first plurality of secondary mechanical actuators 40 may extend between the first support bracket 30 and one of the plurality of drum segments 24. A second plurality of secondary mechanical actuators 42 may also extend between the second support bracket 32 and one of the plurality of drum segments 24. For clarity, only one secondary mechanical actuator 40 and one secondary mechanical actuator 42 are shown in FIG. 1. In certain embodiments, the first plurality of secondary mechanical actuators 40 may extend between one of the first plurality of expandable spokes 20 and the first support bracket 30, and the second plurality of secondary mechanical actuators 42 may extend between one of the second plurality of expandable spokes 22 and the second support bracket 32. As described in detail below, the first and second pluralities of secondary mechanical actuators 40 and 42 may be used to move the first and second pluralities of expandable spokes 20 and 22 between retracted and extended positions, respectively.

Figure 2:
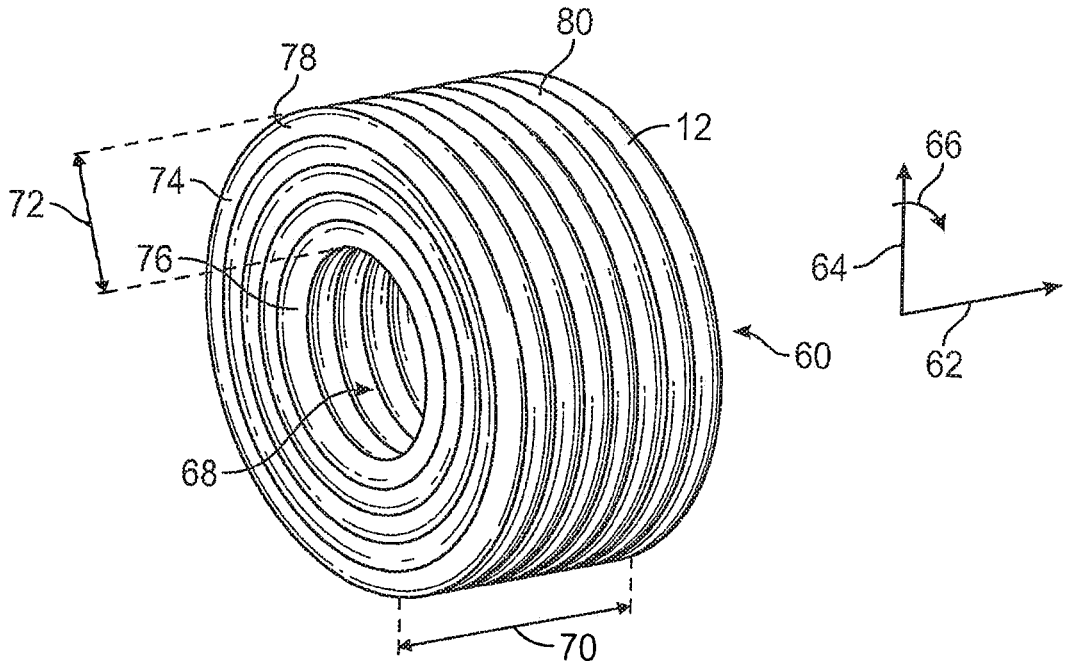
FIG. 2 is a perspective view of a coil of spoolable pipe according to embodiments of the present disclosure.

FIG. 2 illustrates a perspective view of an embodiment of a coil 60 of spoolable pipe 12. The coil 60 may be defined by an axial axis or direction 62, a radial axis or direction 64, and a circumferential axis or direction 66. The coil 60 may be formed by wrapping the spoolable pipe 12 into a coil with an interior channel 68 formed axially 62 therethrough, where the coil 60 may be moved as a single package or bundle of coiled pipe, as shown in FIG. 2. Each complete turn of coiled pipe may be referred to as a wrap of pipe. Multiple wraps of pipe in the coil 60 may be configured in columns along the axial direction 62 of the coil 60 and/or configured in layers along the radial direction 64 of the coil 60. For example, multiple columns of wraps may be formed along the axial direction 62 of the coil 60, where an axial dimension 70 of the coil 60 is based on the diameter of the pipe 12 and the number and axial 62 position of wraps forming the coil 60. Further, multiple layers of wraps may be formed along the radial direction 64 of the coil 60, where a radial dimension 72 of the coil 60 is based on the diameter of the pipe and the number and radial 64 position of the wraps forming the coil 60. In certain embodiments, a weight of the coil 60 may exceed 40,000 pounds (18,144 kilograms).

As shown in FIG. 2, the coil 60 of spoolable pipe 12 may be one or more layers (e.g., layers 74 and 76) of pipe packaged or bundled into the coil 60. The coil 60 may include at least one or more layers of pipe that have been coiled into a particular shape or arrangement. As shown in FIG. 2, the coil 60 is coiled into a substantially cylindrical shape having substantially circular bases 78 and 80 formed on each end of the coil 60, where the axial dimension 70 of the coil 60 is measured between the two bases 78 and 80.

As known to those of ordinary skill in the art, the spoolable pipe 12 used to make up the coil 60 shown in FIG. 2 may be coiled using spoolers or other coiler machines suited for such a function. Those of ordinary skill will recognize that the present disclosure is not limited to any particular form of coiler or other device that may be used to form pipe into a coil. Coiling pipe into a coil of pipe, such as 60, assists when transporting pipe, which may be several hundred feet in length in one or more embodiments. Further, the coil 60 may be assembled as a coil to facilitate deployment of the coil. Deployment, as used herein, may refer to the action of unspooling or unwinding the spoolable pipe 12 from the coil 60.

After being assembled into a coil, the coil 60 shown in FIG. 2 may include the interior channel 68 formed axially 62 through the coil 60. The interior channel 68 is a bore disposed generally in the center of the coil 60. The interior channel 68 is substantially circular-shaped. The coil 60 may have an outer diameter (OD) and an inner diameter (ID), where the inner diameter is defined by the interior channel 68.

Figure 3:
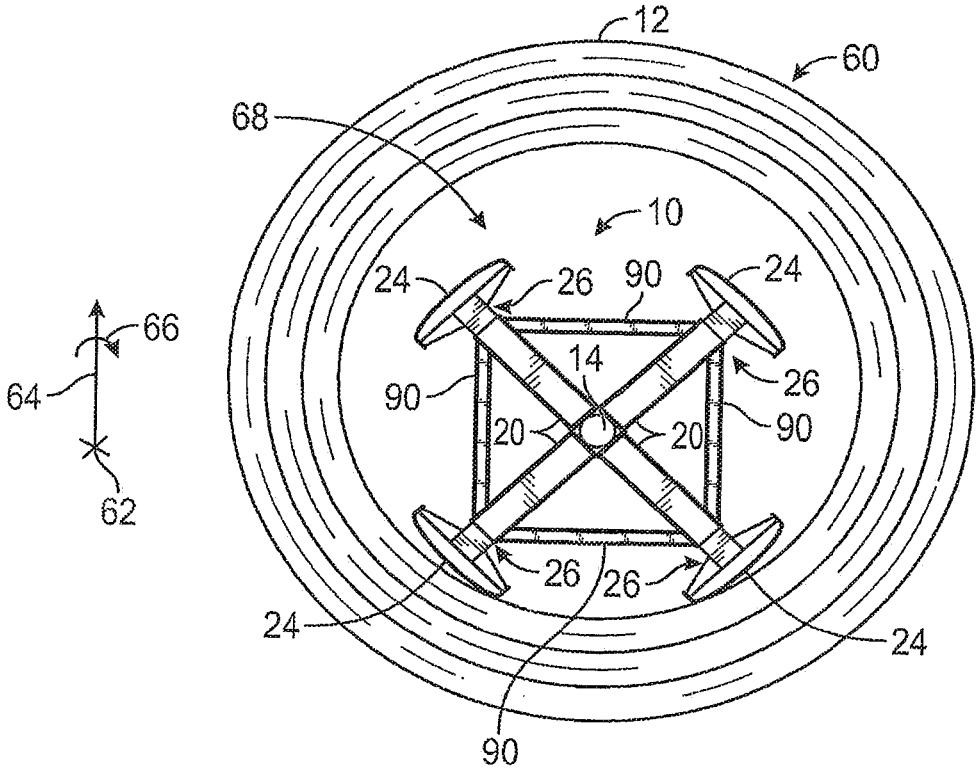
FIG. 3 is a side view of a drum assembly disposed in a retracted position according to embodiments of the present disclosure.

FIG. 3 illustrates a side view of the first end 16 of an embodiment of the drum assembly 10 disposed in the interior channel 68 of the coil 60 with each of the distal ends 26 of the first plurality of expandable spokes 20 in the retracted position. Thus, the drum assembly 10 may also be described as in the retracted position. As shown in FIG. 3, the retracted drum assembly 10 is disposed toward the bottom of the interior channel 68 resting on two of the plurality of drum segments 24. The other two of the plurality of drum segments 24 are not in contact with the coil 60. The retracted position of the drum assembly 10 may enable the drum assembly 10 to be easily inserted into the interior channel 68 with enough clearance to avoid contact with the coil 60 during insertion, thereby avoiding any possible damage to the spoolable pipe 12. The drum assembly 10 may be inserted into the interior channel 68 using a variety of different machinery and techniques as described in more detail below. In certain embodiments, a plurality of spoke frames 90 may be used to provide cross-support to the first plurality of expandable spokes 20. The plurality of spoke frames 90 may be rods, beams, columns, or similar objects coupled between each of the first plurality of expandable spokes 20 to provide support to the expandable spokes 20 during handling, shipment, expansion, and retraction of the drum assembly 10. Although the discussion above refers to the first end 16, it applies equally to the second end 18 and components of the drum assembly 10 disposed at the second end 18, such as the second plurality of expandable spokes 22. In addition, although four drum segments 24 are shown in FIG. 3, other embodiments of the drum assembly 10 may include different numbers of drum segments, such as, but not limited to, two, six, or eight drum segments 24.

Figure 4:
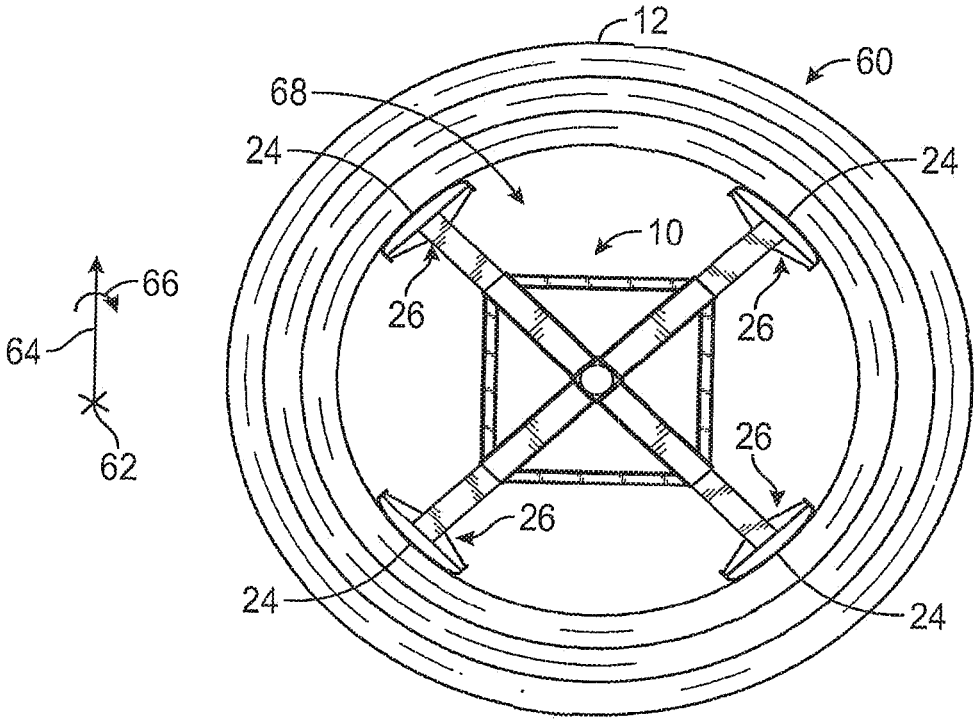
FIG. 4 is a side view of a drum assembly in an extended position according to embodiments of the present disclosure.

FIG. 4 illustrates a side view of the first end 16 of an embodiment of the drum assembly 10 disposed in the interior channel 68 of the coil 60 with each of the distal ends 26 of the first plurality of expandable spokes 20 in the extended position. Thus, the drum assembly 10 may also be described as in the extended position. As shown in FIG. 4, all of the plurality of drum segments 24 are in contact with the coil 60 with enough pressure on the interior channel 68 such that the coil 60 is secured to the drum assembly 10. Outer surfaces of the plurality of drum segments 24 may have a cross-sectional shape generally conforming with the curved shaped of the interior channel 68, thereby evenly distributing the pressure across the interior channel 68. In other words, the drum segments 24 may have a semi-circular shape to correspond to the semi-circular shape of the interior channel 68. Thus, the expanded drum assembly 10 may be used to fully support the coil 60, such as during handling and deployment of the coil 60. In particular, the expanded drum assembly 10 and coil 60 can be handled in a similar manner to spoolable pipe 12 disposed on a reel or spool. However, one drum assembly 10 may be used to handle many coils 60 without the logistics associated with empty reels or spools. In addition, use of the drum assembly 10 enables heavier coils 60 of spoolable pipe 12 to be handled and transported because the weight of reels or spools is not involved. As with FIG. 3, although the discussion above refers to the first end 16, it applies equally to the second end 18 and components of the drum assembly 10 disposed at the second end 18, such as the second plurality of expandable spokes 22.

Figure 5:
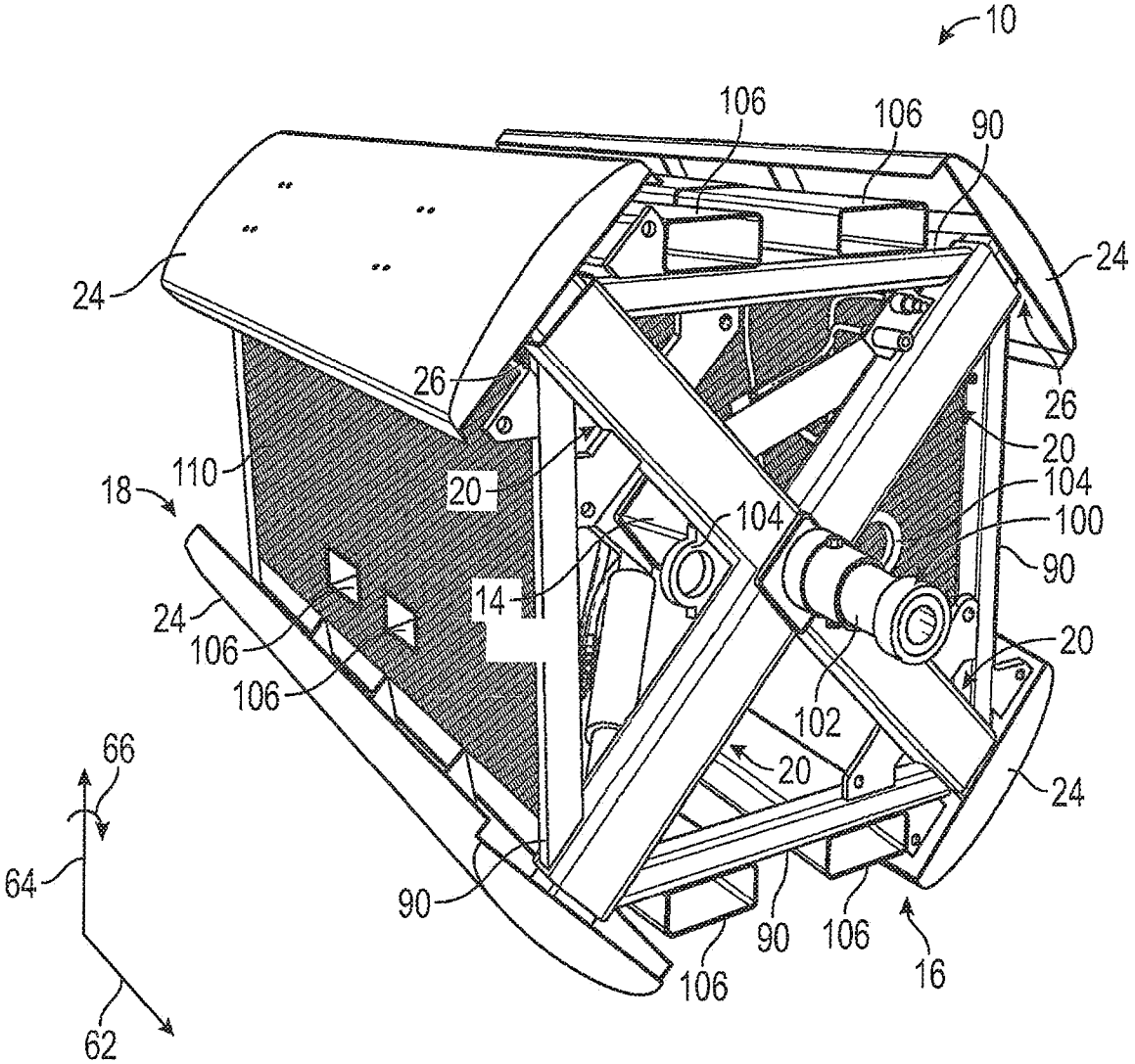
FIG. 5 is a perspective view of a drum assembly in a retracted position according to embodiments of the present disclosure.

FIG. 5 illustrates a perspective view of the first end 16 of an embodiment of the drum assembly 10 in the retracted position. As with previous figures, discussion referring to the first end 16 generally applies equally to the second end 18. As shown in FIG. 5, the support bar 14 extends axially 62 through the center of the drum assembly 10. In certain embodiments, a first hub 100 is disposed at the first end 16 and the first hub 100 includes a first hub shaft 102, which may have a circular cross-sectional shape. Although not shown in the perspective view of FIG. 5, the drum assembly 10 may also include a second hub and second hub shaft disposed at the second end 18 similar to the first hub 100 and first hub shaft 102. In certain embodiments, the first hub 100 and second hub may be referred to as integrated hubs because the first hub 100 and second hub may eliminate the use of a hollow support bar with open ends along the axial axis 62 of the drum assembly 10 for inserting a rod or pole for lifting and deploying the drum assembly 10. Instead, integrated hubs such as the first hub 100 and the second hub may act together with the support bar 14 as a fixed axle with respect to the drum assembly 10. In addition, the first hub shaft 102 and second hub shaft provide fixed locations for a user to grab or manipulate the drum assembly 10, either by hand or with a forklift, without using a rod, pole, or other similar lifting equipment.

In particular, the first hub 100 and second hub can be used to handle and move the drum assembly 10. In addition, when the drum assembly 10 is placed in an appropriate frame, trailer, or other deployment device, the first hub shaft 102 and second hub shaft may be used to enable rotation of the drum assembly 10. In other words, the first hub shaft 102 and second hub shaft may fit within a circular opening of the frame, trailer, or other deployment device to allow the drum assembly 10 to rotate. In certain embodiments, one or more pad-eyes 104 may be disposed at the first and second ends 16 and 18 to enable handling of the drum assembly 10. For example, straps, ropes, chains, or similar securement devices may be coupled to the pad-eyes 104 to facilitate movement of the drum assembly 10. The pad-eyes 104 may be coupled to the support bar 14, expandable spokes 20 or 22, spoke frames 90, or other appropriate locations of the drum assembly 10. In further embodiments, the drum assembly 10 may include at least two fork channels 106 that extend axially 62 or radially 64 along the support bar 14. The forks or tines of a forklift, truck, or similar machinery may be inserted into the fork channels 106 to enable lifting and moving the drum assembly 10. For example, fork channels 106 that extend axially 62 may be used to insert and remove the drum assembly 10 from the interior channel 68 of the coil 60. Fork channels 106 that extend radially 64 may be used to lift or set the drum assembly 10 from a truck, railcar, or similar transportation or used when access to the fork channels 106 extending axially 62 is limited or restricted. The fork channels 106 may be coupled to the support bar 14, expandable spokes 20 or 22, spoke frames 90, or other appropriate locations of the drum assembly 10.

In certain embodiments, the drum assembly 10 may include a cage 110 that at least partially covers one or more components of the drum assembly 10. For example, the cage 110 may help to protect components of the drum assembly 10 when the drum assembly 10 is moved or handled via the fork channels 106. The cage 110 may be made from expanded metal or mesh and coupled to the support bar 14, expandable spokes 20 or 22, spoke frames 90, fork channels 106, or other appropriate locations of the drum assembly 10.

Figure 6:
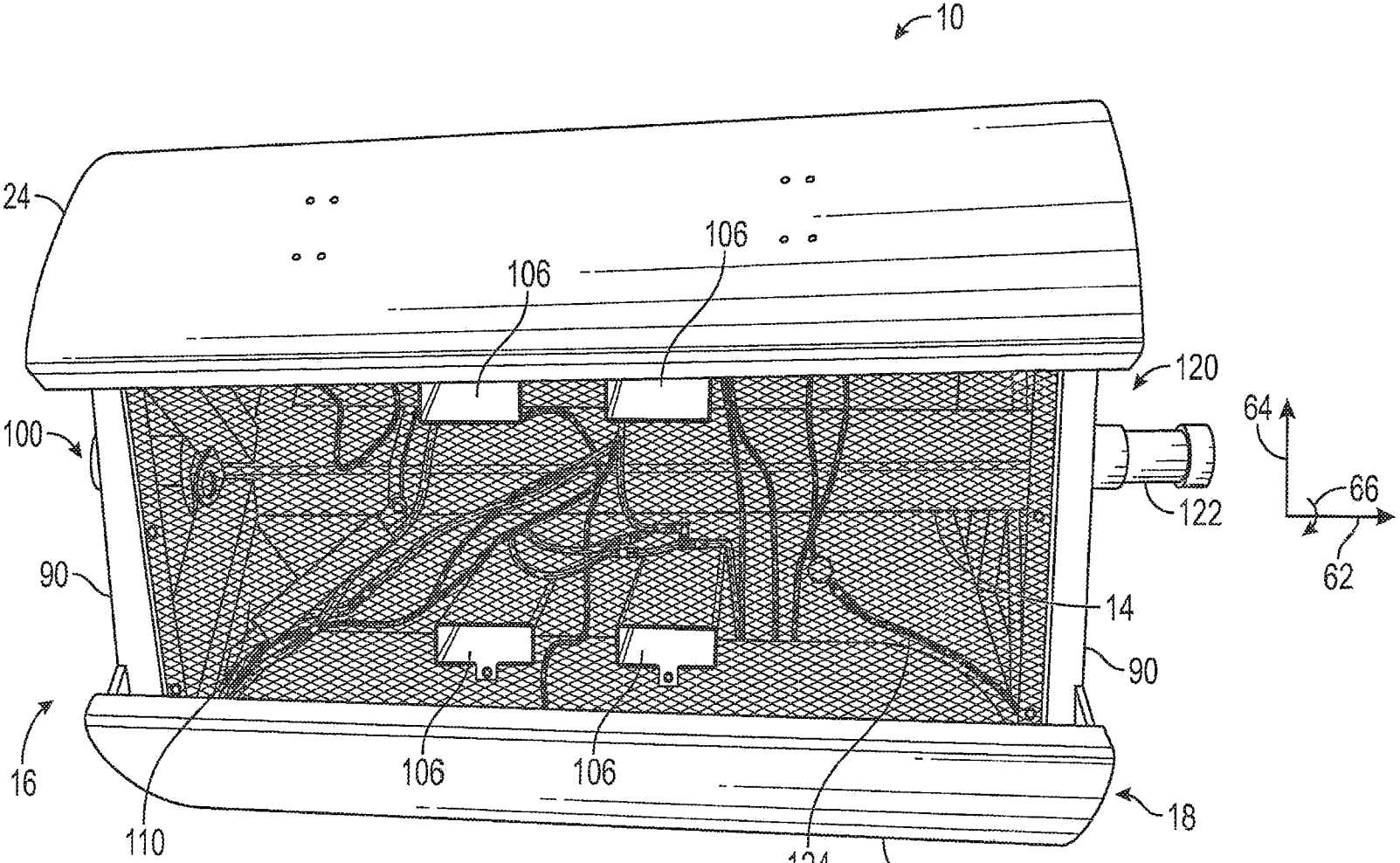
FIG. 6 is a perspective view of a drum assembly in a retracted position according to embodiments of the present disclosure.

FIG. 6 illustrates a perspective view of an embodiment of the drum assembly 10 from the side in the retracted position. As shown in the illustrated embodiment, the support bar 14 includes the first hub 100 and a second hub 120 and a second hub shaft 122. The support bar 14 extends axially 62 through the center of the drum assembly 10. Fork channels 106 may extend radially 64 through the drum assembly 10 for handling by a forklift or similar device. In the illustrated embodiment, four fork channels 106 are provided, with two below the support bar 14 and two above the support bar 14. Thus, the drum assembly 10 may be picked up using the two fork channels 106 above the support bar 14 so the center of mass of the drum assembly 10 is lower than the forks or tines of the forklift. If the drum assembly 10 is flipped over, then the other two fork channels 106 may be used. Thus, placement of the fork channels 106 both above and below the support bar 14 enables the drum assembly 10 to be handled in either orientation. In further embodiments, different numbers of fork channels 106 may be provided, such as, two, six, or more fork channels 106. The drum assembly 10 shown in FIG. 6 also includes a plurality of hydraulic hoses 124 that may be coupled to one or more hydraulic cylinders of the drum assembly 10, as described in more detail below. As used herein, hydraulic cylinders may also be referred to as linear hydraulic motors. The cage 110 may also help to protect the hydraulic hoses 124 when the drum assembly 10 is moved or handled via the fork channels 106.

Figure 7:
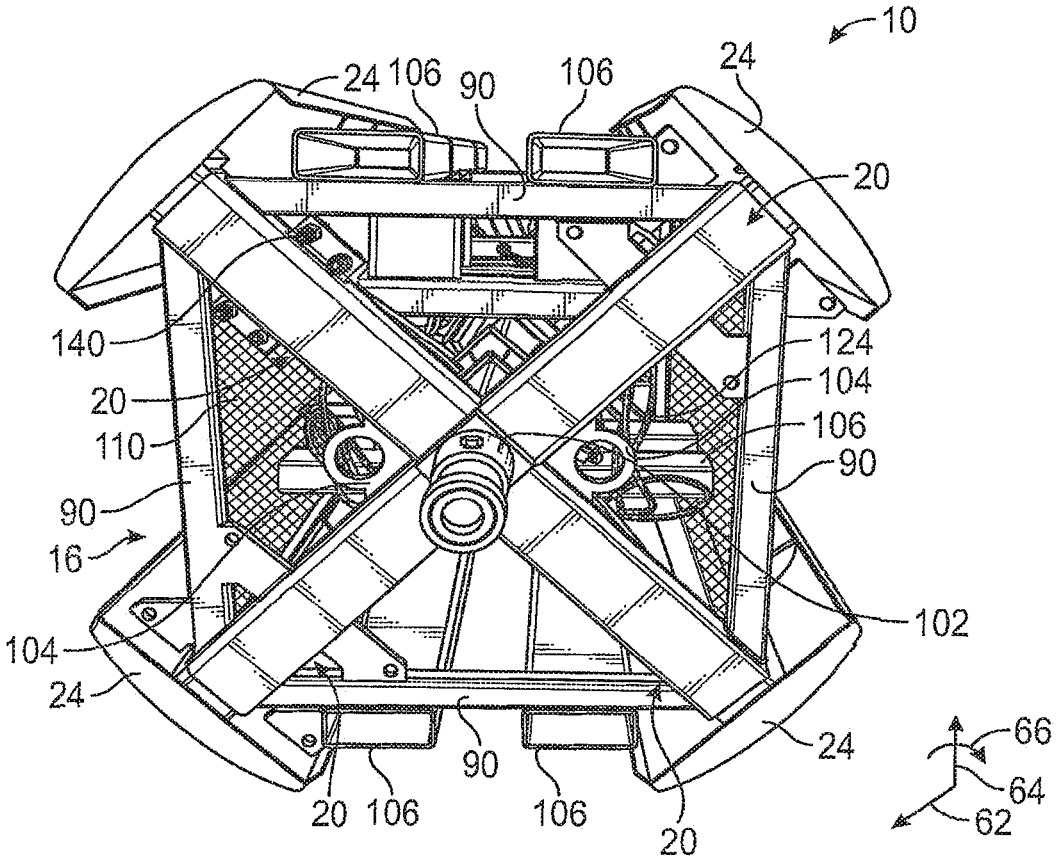
FIG. 7 is a perspective view of a drum assembly in a retracted position according to embodiments of the present disclosure.

FIG. 7 illustrates a perspective view of an embodiment of the drum assembly 10 from the front end 16 in the retracted position. In certain embodiments, one or more hydraulic connections 140 may be provided on one or both of the first and second ends 16 and 18 to enable hydraulic fluid to be provided to the hydraulic hoses 124 and hydraulic components of the drum assembly 10. The hydraulic connections 140 may be placed in any convenient location, such as near the support bar 14, expandable spokes 20 or 22, spoke frames 90, fork channels 106, or other appropriate locations of the drum assembly 10. The hydraulic components of the drum assembly 10 may be manipulated by means of a stand-alone hydraulic power unit (HPU) or an HPU connected to an installation trailer. Further, the drum assembly 10 may be operated manually or via electronic control with limit switches, for example, in certain illustrative embodiments.

Figure 8:
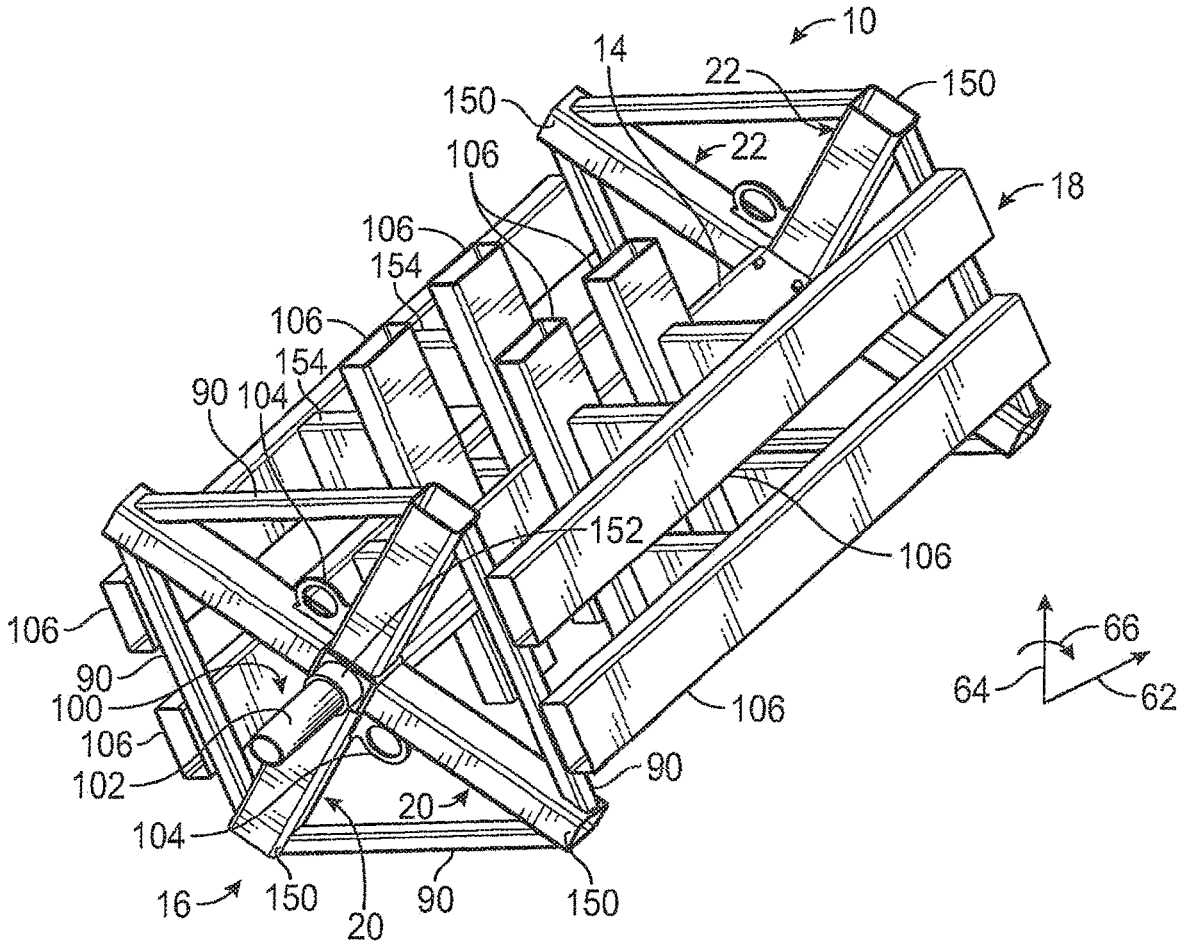
FIG. 8 is a perspective view of a portion of a drum assembly according to embodiments of the present disclosure.

FIG. 8 is a perspective view of a portion of an embodiment of the drum assembly 10. The plurality of drum segments 24 are omitted to better illustrate internal details of the drum assembly 10. In particular, the first and second pluralities of expandable spokes 20 and 22 include a plurality of rigid spokes 150 (e.g., hollow tubes), which may be made from square tubing of steel or similar composition. As described in more detail below, the rigid spokes 150 do not move during extension of the drum assembly 10. Instead, the plurality of drum segments 24 may include square tubing that slides into and out of interiors of the plurality of rigid spokes 150 during retraction and extension of the drum assembly, respectively. In other embodiments, the rigid spokes 150 may have other cross-sectional shapes, such as circles or rectangles. In the illustrated embodiment, the support bar 14 may be made from square tubing of steel or similar composition. In other embodiments, the support bar 14 may have other cross-sectional shapes, such as circles or rectangles. The spoke frames 90 may also be made from tubing of steel or similar composition with square or other cross-sectional shapes.

As shown in FIG. 8, the drum assembly 10 may include hub spacers 152 disposed around the first and second hub shafts 102 and 122. The hub spacers 152 may help block the first and second pluralities of expandable spokes 20 and 22 from contacting stationary components of the frame, trailer, or other deployment device while the drum assembly 10 is rotating. The fork channels 106 that extend radially 64 may be coupled to the fork channels that extend axially 62 via one or more fork offsets 154, which may be made from tubing of steel or similar composition with square or other cross-sectional shapes. Although one embodiment of the drum assembly 10 is shown in FIG. 8, other configurations are possible that provide the same or similar functionality.

Figure 9:
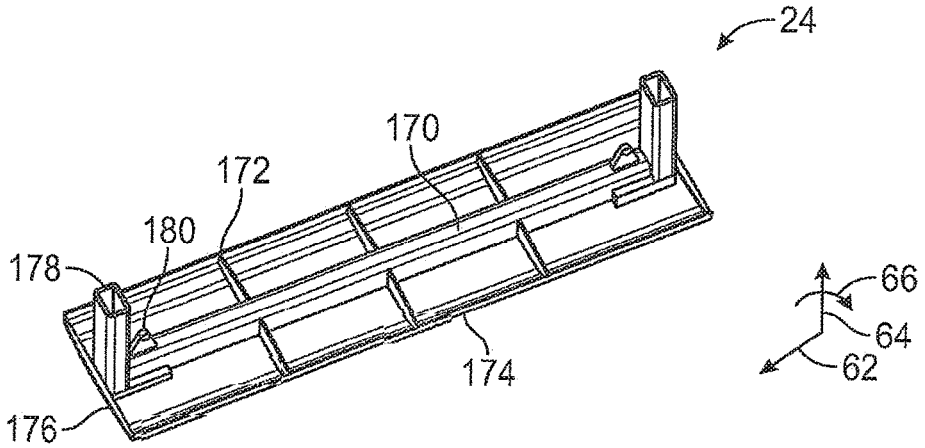
FIG. 9 is a perspective view of a drum segment according to embodiments of the present disclosure.

FIG. 9 is a perspective view of an embodiment of one of the plurality of drum segments 24. In particular, the drum segment 24 shown in FIG. 9 may be used together with the portion of the drum assembly 10 shown in FIG. 8. The drum segments 24 may be fabricated from separate components to provide an assembly that can support a portion of the weight of the coil 60 without damaging the coil 60. For example, the drum segment 24 may include a cross member 170 that may be made from tubing of steel or similar composition with square or other cross-sectional shapes. The cross member 170 provides support for one or more other components of the drum segment 24, such as gussets 172, drum sheet 174, end plates 176, support spokes 178 (e.g., rigid members), and mechanical actuator connectors 180. The gussets 172 may be made from sheet metal and used to provide structural support and stability for the drum segment 24. The drum sheet 174 may also be made from sheet metal and have a curved outside surface generally conforming with the curved surface of the interior channel 68 of the coil 60. Thus, the curved surface of the drum sheet 174 helps reduce the potential for damage to the coil 60 and also distributes the weight of the coil 60 evenly across the surface area of the drum segment 24. The end plates 176 may be made from sheet metal and serve a similar purpose to the gussets 172 in addition to covering the ends of the drum segment 24. The support spokes 178 may be made from tubing of steel or similar composition with square or other cross-sectional shapes and configured to fit inside the rigid spokes 150 of the drum assembly 10. In other words, the support spokes 178 may have the same cross-sectional shape as the rigid spokes 150 and also have a diameter or cross-sectional area less than that of the rigid spokes 150 to enable the support spokes 178 to slide into and out of the rigid spokes 150 telescopically during extension and retraction of the drum assembly 10. Finally, the mechanical actuator connectors 180 may provide connection points for the first and second pluralities of secondary mechanical actuators 40 and 42. For example, the first and second pluralities of secondary mechanical actuators 40 and 42 may couple to the mechanical actuator connectors 180 via a clevis connection or other type of fastener device to enable the first and second pluralities of secondary mechanical actuators 40 and 42 to rotate about the mechanical actuator connectors 180 during extension and retraction of the drum assembly 10. In certain embodiments, the mechanical actuator connectors 180 may be disposed on the support spokes 178 instead of the cross member 170.

Figure 10:
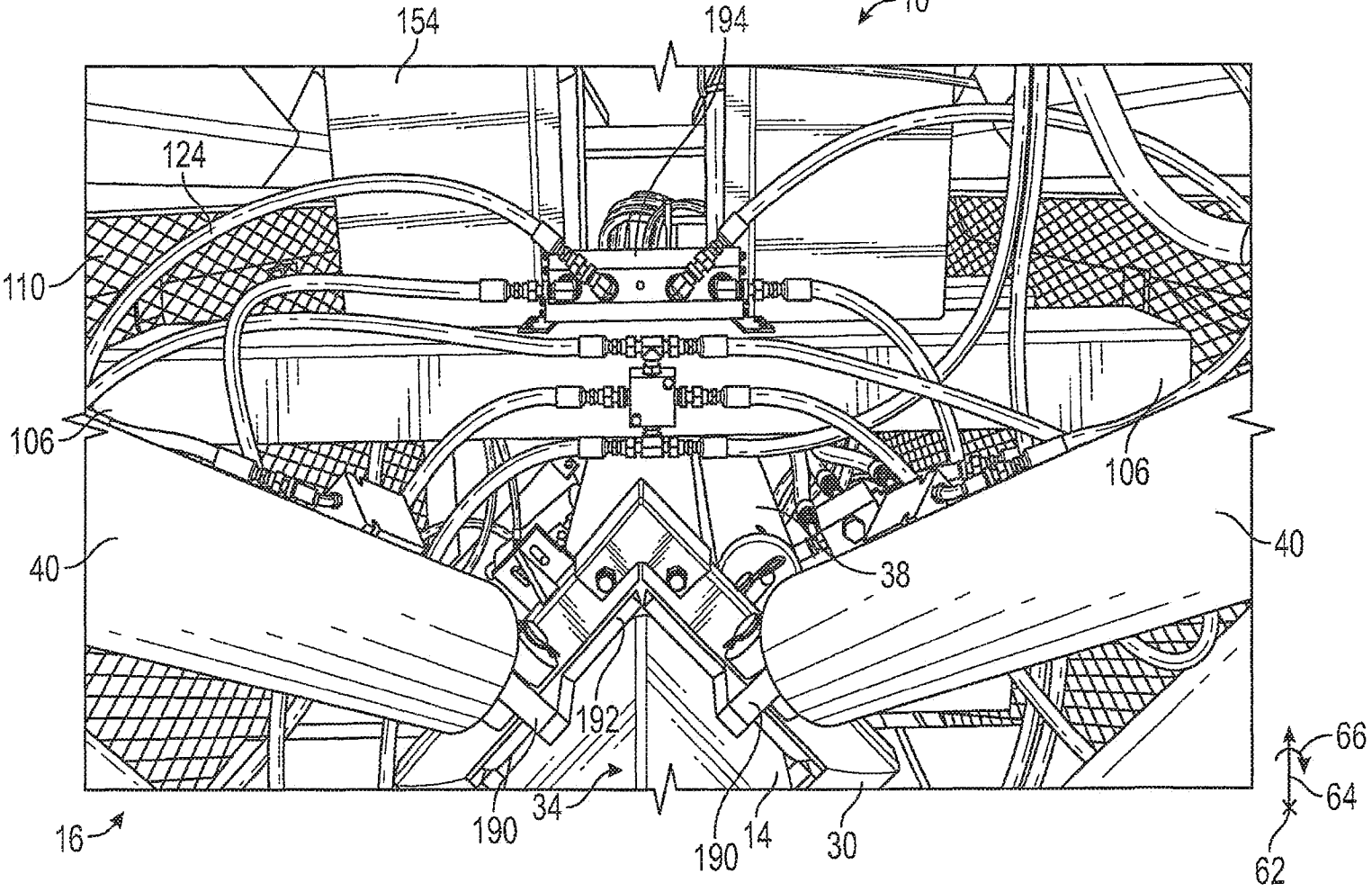
FIG. 10 is a perspective view of a portion of a drum assembly according to embodiments of the present disclosure.

FIG. 10 illustrates a perspective view of a portion of an embodiment of the drum assembly 10 from the first end 16. Certain elements disposed at the second end 18 are discussed below together with the corresponding elements disposed at the first end 16 although not shown in FIG. 10. As shown in FIG. 10, the first support bracket 30 is disposed about the support bar 14. The support bar 14 may be made from tubing of steel or similar composition with square or other cross-sectional shapes. In the illustrated embodiment, the support bar 14 is made from square tubing. As such, the first support bracket 30 also has a square interior shape to fit around the support bar 14. The first support bracket 30 includes bracket connectors 190 that provide connection points for the first and second pluralities of secondary mechanical actuators 40 and 42. For example, the first and second pluralities of secondary mechanical actuators 40 and 42 may couple to the bracket connector 190 via a clevis connection or other type of fastener device to enable the first and second pluralities of secondary mechanical actuators 40 and 42 to rotate about the bracket connectors 190 during extension and retraction of the drum assembly 10. In addition, the primary mechanical actuator 38 may be coupled to the first support bracket 30 to enable the first support bracket 30 to move along the first longitudinal section 34 of the support bar 14. In certain embodiments, the primary mechanical actuator 38 may be a hydraulic cylinder. In various embodiments, two, three, four, or more primary mechanical actuators 38 may be coupled to and evenly spaced about the first support bracket 30.

In certain embodiments, the first support bracket 30 may include a support bar contact surface 192 configured to provide a low-friction or non-stick surface to enable the first support bracket 30 to freely slide over the outer surface of the support bar 14. For example, the support bar contact surface 192 may be made from ultra-high-molecular-weight (UHMW) plastics or similar materials. In further embodiments, the drum assembly 10 includes a flow distributor 194 configured to distribute flow of hydraulic fluid to one or more of the first and second pluralities of secondary mechanical actuators 40 and 42. In particular, the flow distributor 194 acts as an equalizer of hydraulic fluid flow to the first and second pluralities of secondary mechanical actuators 40 and 42 such that the plurality of drum segments 24 are moved evenly during extension and retraction of the drum assembly 10. In other words, the flow distributor 194 allows the drum segments 24 to extend or retract at the same pace ensuring that both the first and second ends 16 and 18 of the drum segments 24 move without binding. The flow distributor 194 also allows for proper sequencing of the movement of all the drum segments 24. As with previous figures, although the discussion above refers to the first end 16, it applies equally to the second end 18 and components of the drum assembly 10 disposed at the second end 18, such as the second support bracket 32.

Figure 11:
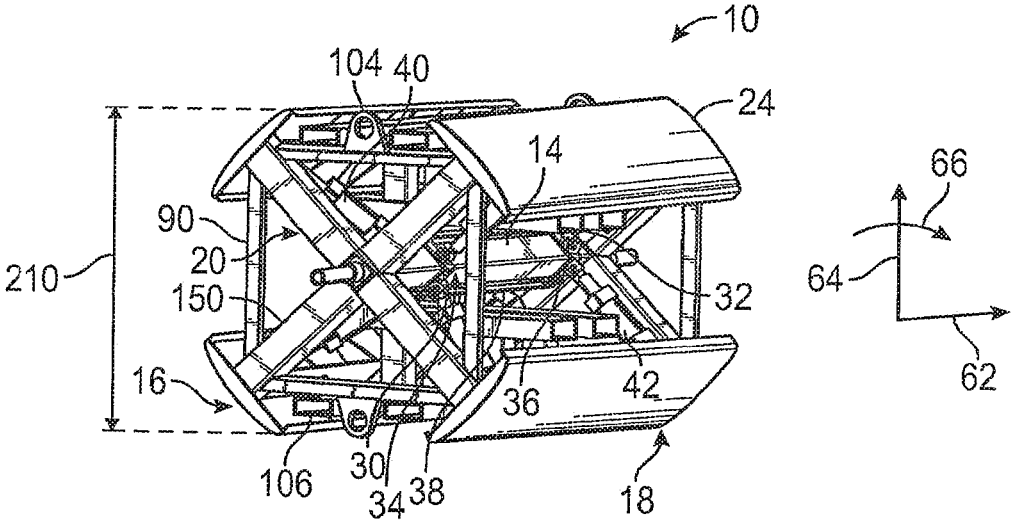
FIG. 11 is a perspective view of a drum assembly in a retracted position according to embodiments of the present disclosure.
Figure 12:
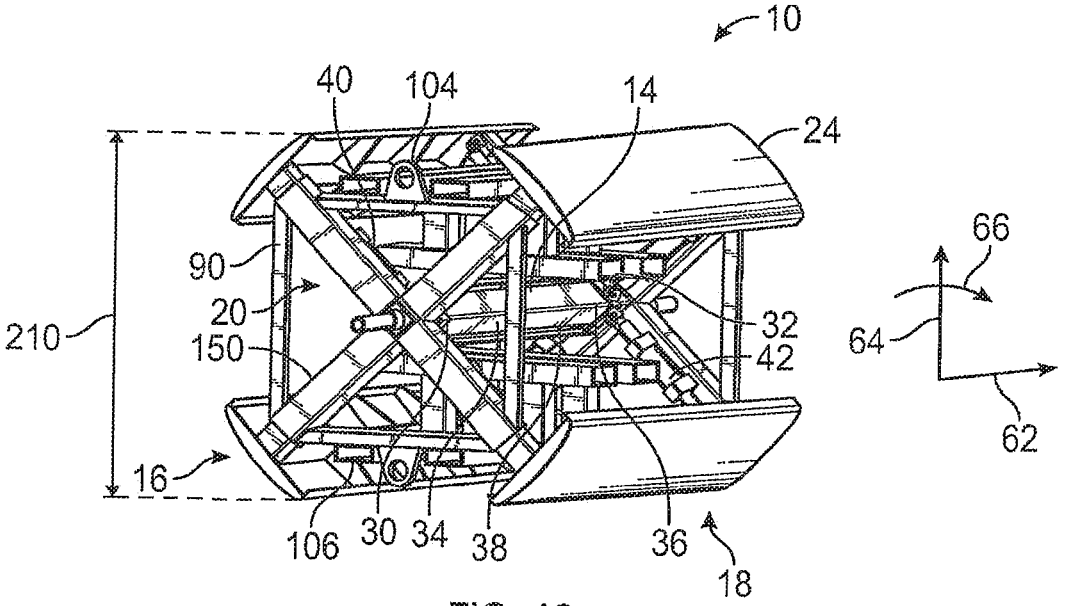
FIG. 12 is a perspective view of a drum assembly in a partially extended position according to embodiments of the present disclosure.
Figure 13:
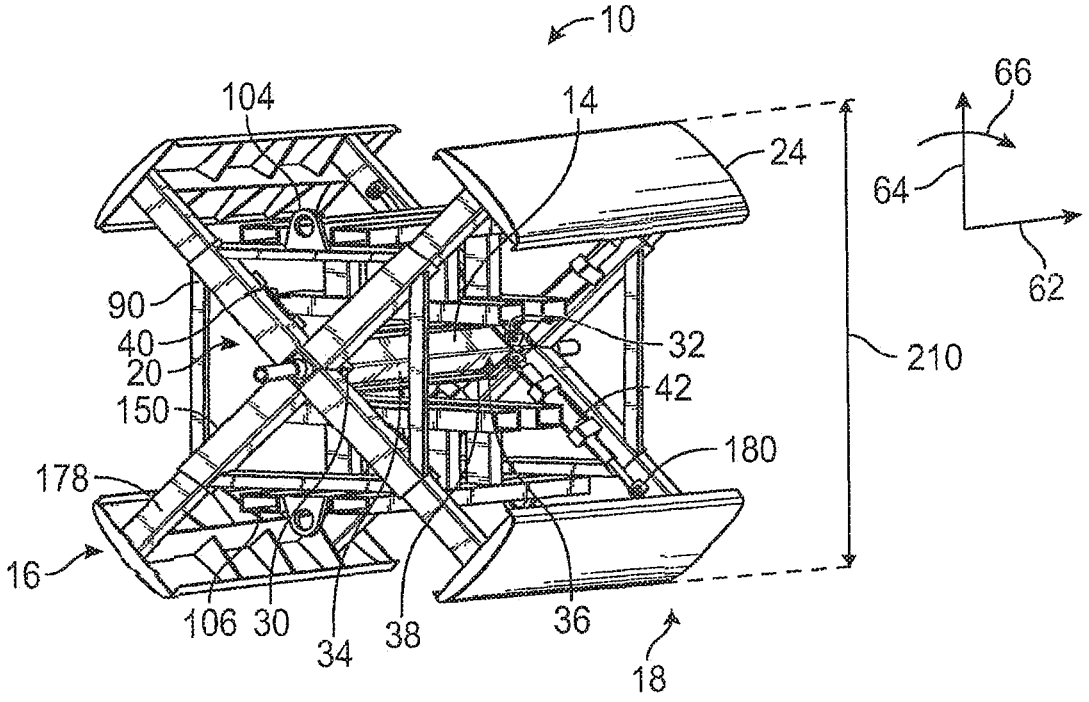
FIG. 13 is a perspective view of a drum assembly in an extended position according to embodiments of the present disclosure.

FIGS. 11-13 are perspective views of an embodiment of the drum assembly 10 being expanded from a fully retracted position in FIG. 11 to a fully extended position in FIG. 13. Reversing the steps described below would result in the drum assembly returning to the fully retracted position. In FIG. 11, the support spokes 178 (not shown) are disposed within the rigid spokes 150 and the first support bracket 30 is disposed along first longitudinal section 34 in a position furthest away from the first end 16. In addition, the primary mechanical actuator 38 and the first and second pluralities of secondary mechanical actuators 40 and 42 may all be in fully retracted positions. As such, an outer diameter 210 of the drum assembly 10 may be small enough for the drum assembly 10 to be inserted into the interior channel 68 of the coil 60. In FIG. 12, the drum assembly 10 is shown in a partially extended position. Thus, the outer diameter 210 is larger than that shown in FIG. 11. In addition, the primary mechanical actuator 38 has extended to move the first support bracket 30 in a position close to the first end 16. For example, the first support bracket 30 may be disposed against a back side of the rigid spokes 150. Because of the movement of the first support bracket 30, the first and second pluralities of secondary mechanical actuators 40 and 42 may move from being inclined with respect to the axial axis 62 to being generally aligned with the radial axis 64 (i.e., perpendicular to the axial axis 62). This alignment of the first and second pluralities of secondary mechanical actuators 40 and 42 may cause the plurality of drum segments 24 to be at least partially extended such that small portions of the support spokes 178 are visible. In FIG. 13, the first and second pluralities of secondary mechanical actuators 40 and 42 may all be in fully extended positions, thereby extending the plurality of drum segments 24. As such, the outer diameter 210 is larger than that shown in FIG. 12 and may coincide with the diameter of the interior channel 68 of the coil 60. Thus, the drum assembly 10 may be used to move and handle coils 60 of spoolable pipe 12. In addition, larger portions of the support spokes 178 are visible when the drum assembly 10 is fully extended. As with previous figures, although the discussion above refers primarily to the first end 16, it applies equally to the second end 18 and components of the drum assembly 10 disposed at the second end 18.

Figure 14:
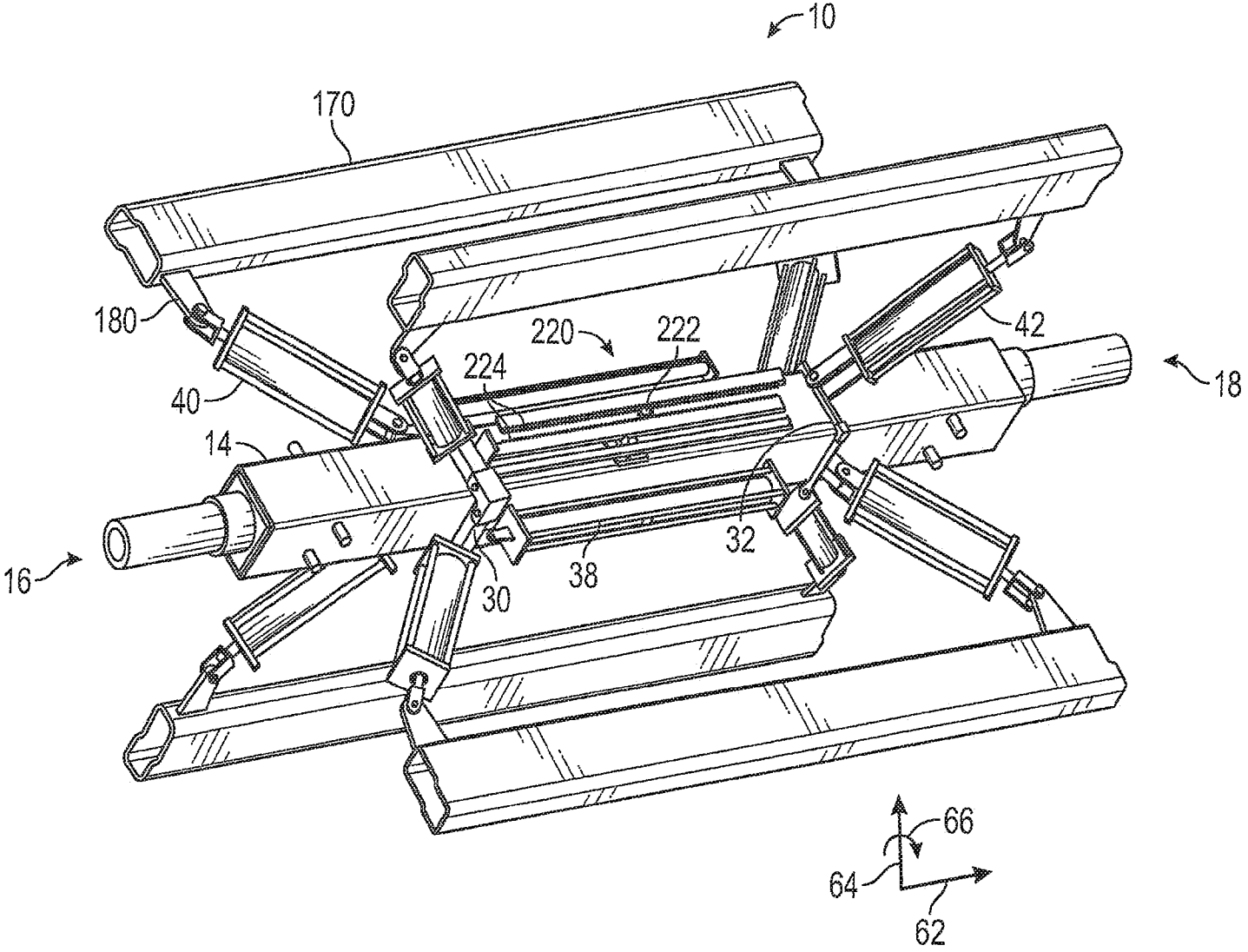
FIG. 14 is a perspective view of a portion of a drum assembly according to embodiments of the present disclosure.

FIG. 14 illustrates a perspective view of a portion of an embodiment of the drum assembly 10. Most of the plurality of drum segments 24 have been removed leaving only portions of the cross members 170 for clarity. In the illustrated embodiment, a rack and pinion 220 is used instead of the flow distributor 194 described above. In particular, the rack and pinion 220 includes a pinion gear 222 and two racks 224. One of the two racks 224 is coupled to the first support bracket 30 and the other rack 224 is coupled to the second support bracket 32. Thus, the rack and pinion 220 facilitates the movement of the first and second support brackets 30 and 32 away from each other during extension of the drum assembly 10 and the movement of the first and second support brackets 30 and 32 toward each other during retraction of the drum assembly 10. In other words, the rack and pinion 220 helps to prevent binding of the drum segments 24. In further embodiments, other devices or techniques may be used to provide even movement of the plurality of drum segments 24 besides the flow distributor 194 or the rack and pinion 220, or these components may be omitted. Further, the illustrated embodiment of the drum assembly 10 shows the first and second pluralities of secondary mechanical actuators 40 and 42 as hydraulic cylinders. In other embodiments, the first and second pluralities of secondary mechanical actuators 40 and 42 may use different techniques as described below.

Figure 15:
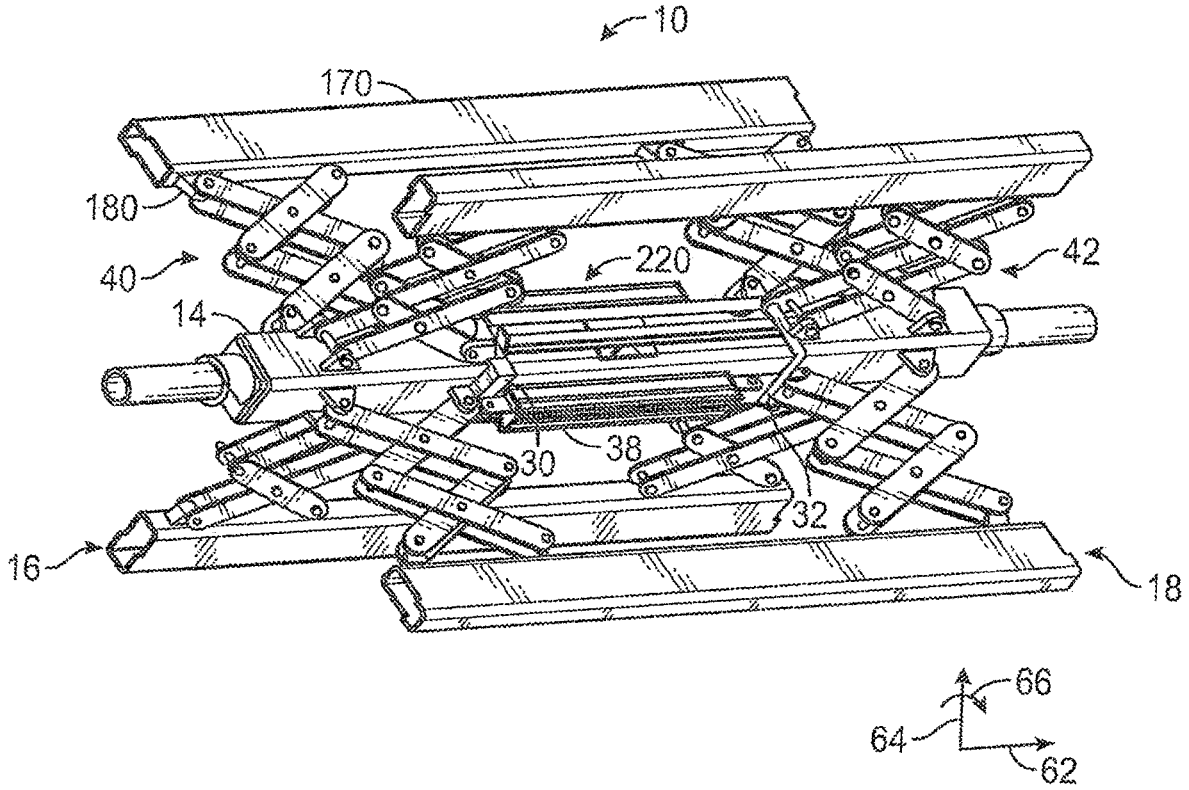
FIG. 15 is a perspective view of a portion of a drum assembly according to embodiments of the present disclosure.

FIG. 15 illustrates a perspective view of a portion of an embodiment of the drum assembly 10. Most of the plurality of drum segments 24 have been removed leaving only portions of the cross members 170 for clarity. In the illustrated embodiment, first and second pluralities of secondary mechanical actuators 40 and 42 are shown as scissor-lift mechanisms instead of the hydraulic cylinders shown in FIG. 14. Thus, extension of the primary mechanical actuator 38 may cause the first and second support brackets 30 and 32 to move in addition to extension of the plurality of drum segments 24. The illustrated drum assembly 10 includes the rack and pinion 220, but in other embodiments, the rack and pinion 220 may be omitted or different techniques used to provide even movement of the drum segments 24.

Figure 16:
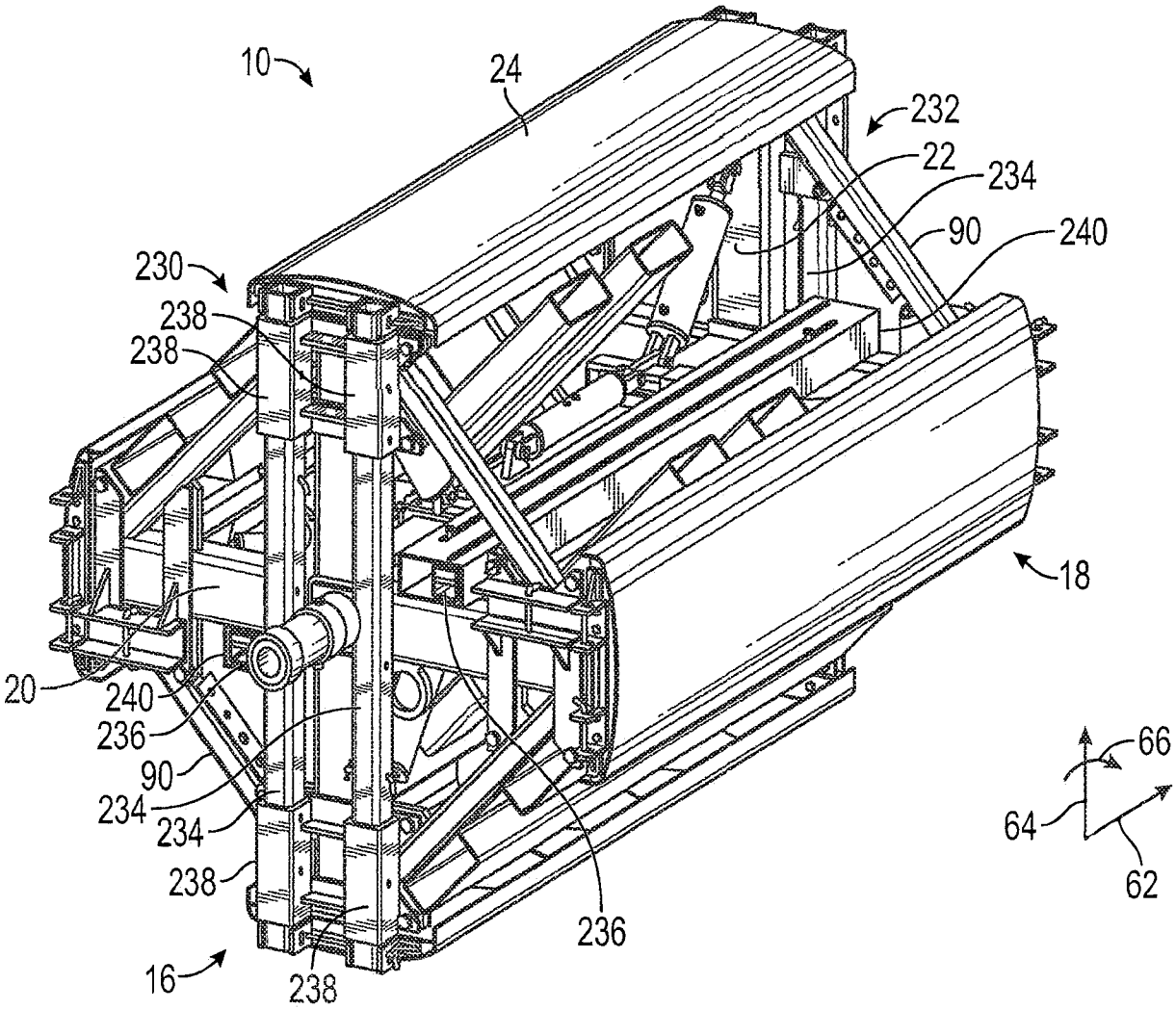
FIG. 16 is a perspective view of a drum assembly with a plurality of extension arms according to embodiments of the present disclosure.

FIG. 16 illustrates a perspective view of an embodiment of the drum assembly 10 with a first plurality of extension arms 230 disposed at the first end 16 and a second plurality of extension arms 232 disposed at the second end 18. The first and second pluralities of extension arms 230 and 232 may be used to help contain the coil 60 while disposed on the drum assembly 10 and are shown in retracted positions in FIG. 16. The first and second pluralities of extension arms 230 and 232 made be made from square tubing of steel or similar composition. In the illustrated embodiment, the first and second pluralities of extension arms 230 and 232 may include radial arms 234 that extend in the radial direction 64 and axial arms 236 that extend in the axial direction 62. As shown in FIG. 16, the radial arms 234 may be at least partially contained in radial arm brackets 238 when not deployed and the axial arms 236 may be at least partially contained in axial arm brackets 240 when not deployed. The radial arm brackets 238 and axial arm brackets 240 may be coupled to the expandable spokes 20 or 22, spoke frames 90, or other appropriate locations of the drum assembly 10.

Figure 17:
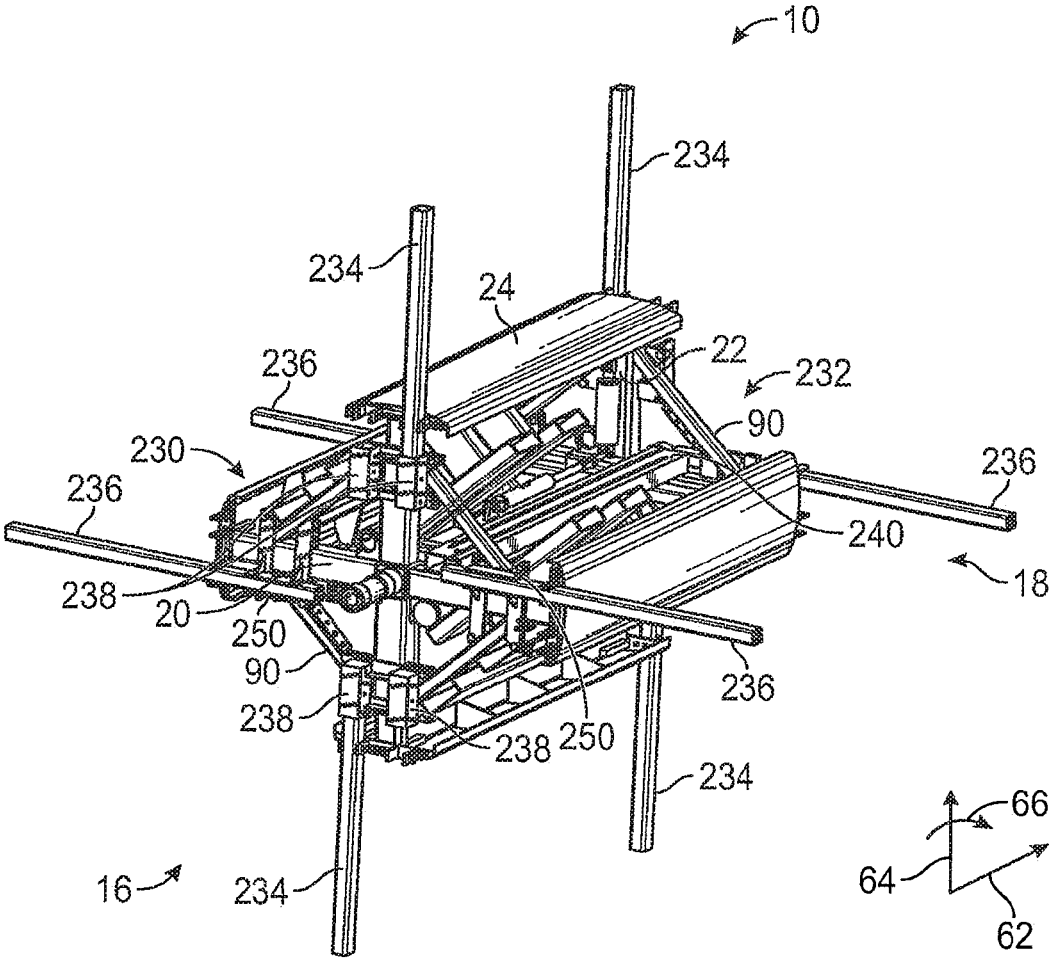
FIG. 17 is a perspective view of a drum assembly with a plurality of extension arms in extended positions according to embodiments of the present disclosure.

FIG. 17 illustrates a perspective view of an embodiment of the drum assembly 10 with the first and second pluralities of extension arms 230 and 232 in extended positions, thereby blocking the spoolable pipe 12 of the coil 60 from moving or shifting past the ends of the plurality of drum segments 24. For example, the radial arms 234 on opposite radial 64 sides of the drum assembly 10 may move away from each other and secure into extended positions using the radial arm brackets 238 and appropriate fasteners, such as, but not limited to, screws, bolts, pins, and so forth. The axial arms 236 may be extended initially in the axial direction 62 until completely removed from the axial arm brackets 240 and then the axial arms 236 may be rotated until extended in opposite radial directions 64. The axial arms 236 may be secured into extended positions using secondary axial arm brackets 250 and appropriate fasteners, such as, but not limited to, screws, bolts, pins, and so forth.

Figure 18:
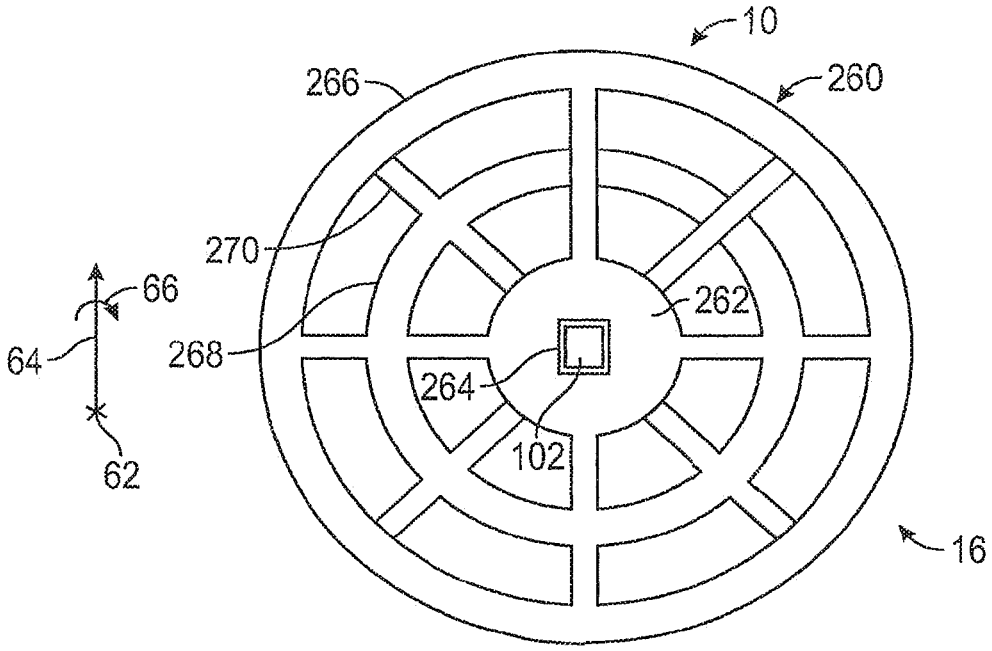
FIG. 18 is a side view of a drum assembly having a containment flange according to embodiments of the present disclosure.

FIG. 18 illustrates a side view of an embodiment of the drum assembly 10 having a containment flange 260 disposed at the first side 16. Details and other components of the drum assembly 10 behind the containment flange 260 have been omitted for clarity. In the illustrated embodiment, the containment flange 260 includes a central hub 262 coupled to the first hub shaft 102. In particular, the first hub shaft 102 has a cross sectional shape matching that of an opening 264 formed in the central hub 262. For example, both the first hub shaft 102 and the opening 264 may have square cross-sectional shapes, but other shapes are possible, such as triangles, rectangles, polygons, ovals, and so forth. The corresponding shapes of the first hub shaft 102 and the opening 264 enable the containment flange 260 to move together with the first hub shaft 102. In other words, the containment flange 260 rotates together with the other rotating components of the drum assembly 10. It can also be said that rotation of the first hub shaft 102 or support bar 14 drives rotation of the containment flange 260. In addition, the corresponding shapes of the first hub shaft 102 and the opening 264 enable the components to be removably coupled to one another to reduce the overall size and weight of the drum assembly 10, such as for transport. In other embodiments, the containment flange 260 and first hub shaft 102 may be removably or not removably coupled together via other techniques, such as, screws, bolts, clamps, welding, brazing, or other fastening techniques. The containment flange 260 may provide a similar function as the first and second plurality of extension arms 230 and 232 described above. For example, the containment flange 260 may include an external ring 266, one or more internal rings 268, and one or more ribs 270 that when coupled together may be used to help contain the coil 60 while disposed on the drum assembly 10. In other words, the containment flange 260 may help block the spoolable pipe 12 of the coil 60 from moving or shifting outside of the space between containment flanges 260. The open structure provided by the external ring 266, one or more internal rings 268, and one or more ribs 270 may help reduce the overall weight of the containment flange 260, but in other embodiments, a solid circular structure may be used for the containment flange 260. As with previous figures, although the discussion above refers primarily to the first end 16, it applies equally to the second end 18 and components of the drum assembly 10 disposed at the second end 18. Specifically, a second containment flange 260 similar to that shown in FIG. 18 may be coupled to the second hub shaft 122. In addition, although the previous discussion has described the containment flange 260 as coupled to the first and second hub shafts 102 and 122, in other embodiments, the containment flange 260 may be coupled to other portions of the support bar 14.

Figure 19:
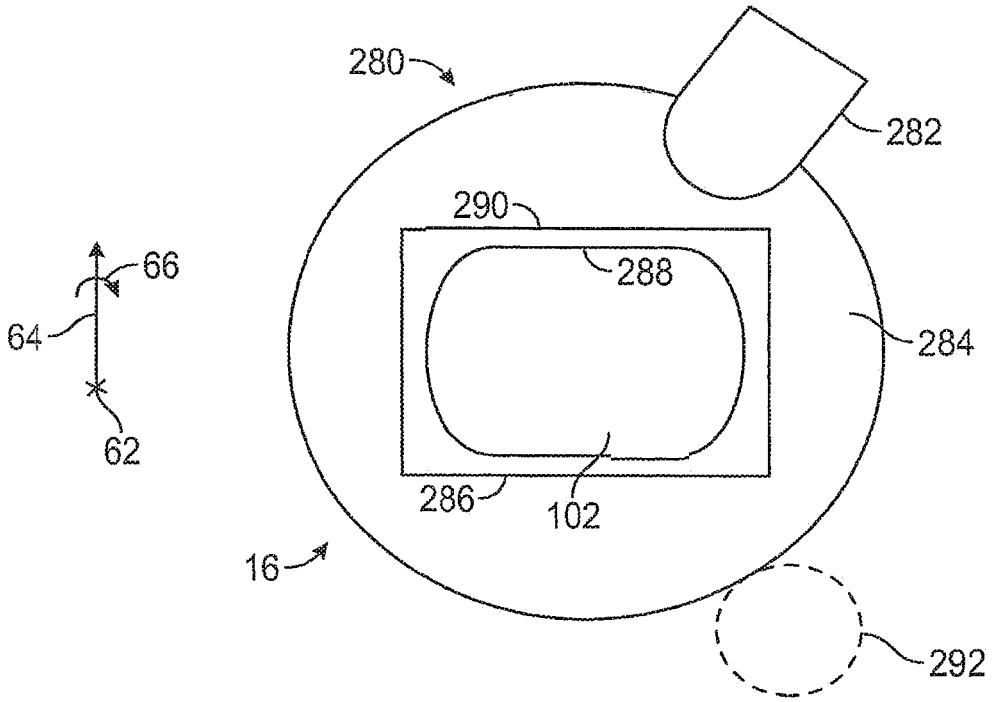
FIG. 19 is a side view of a brake that may be used with a drum assembly according to embodiments of the present disclosure.

FIG. 19 illustrates a side view of an embodiment of a brake 280 that may be used with the drum assembly 10. For example, the brake 280 may be configured as a disc brake or caliper brake having one or more calipers 282 disposed against a rotor 284. In certain embodiments, the rotor 284 may be part of the containment flange 260 or a separate component of the drum assembly 10. The rotor 284 may have an opening 286 that surrounds the first hub shaft 102 or another portion of the support bar 14. As shown in FIG. 19, the opening 286 and the first hub shaft 102 may have corresponding cross-sectional shapes to enable the rotor 284 to move together with the first hub shaft 102. For example, the first hub shaft 102 (or a portion thereof) may have flat sides 288 that correspond to flat sides 290 of the opening 286. In other words, the rotor 284 rotates together with the other rotating components of the drum assembly 10. The brake 280 may be used to slow or stop rotation of the drum assembly 10 by engaging the caliper 282 against the rotor 284. In further embodiments, other braking techniques may be used to control the rotation of the drum assembly 10. For example, the brake 280 may be a drum brake or may have a gear or roller 292 that rotationally engages with the rotor 284. In some embodiments, the brake 280 may use hydraulic motor braking. As with previous figures, although the discussion above refers primarily to the first end 16, it applies equally to the second end 18 and components of the drum assembly 10 disposed at the second end 18.

Figure 20:
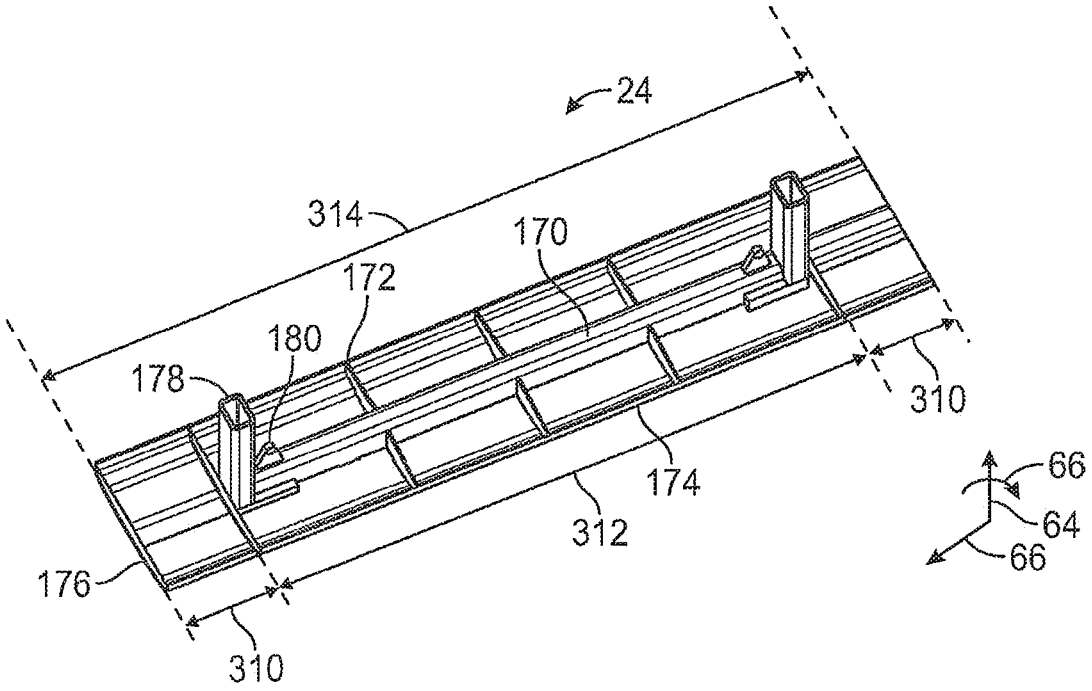
FIG. 20 is a perspective view of a drum segment according to embodiments of the present disclosure.

FIG. 20 illustrates a perspective view of an embodiment of one of the plurality of drum segments 24. The illustrated embodiment of the drum segment 24 is similar to that shown in FIG. 9, but the support spokes 178 are not disposed proximate the end plates 176. Instead, the support spokes 178 are disposed a distance 310 from the end plates 176. Thus, the first and second pluralities of extension arms 230 and 232 or the containment flanges 260 may also be disposed the distance 310 in from the end plates 176, thereby reducing a coil distance 312 between the first and second pluralities of extension arms 230 and 232 or the containment flanges 260. Accordingly, the first and second pluralities of extension arms 230 and 232 or the containment flanges 260 may provide sufficient containment of the coil 260 even if the axial dimension 70 of the coil 60 is less than an overall width 314 of the drum segments 24. In certain embodiments, the first and second pluralities of extension arms 230 and 232 or the containment flanges 260 may be shifted or moved axially 62 to accommodate coils 60 of different axial dimensions 70.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A pipe drum assembly, comprising:

a support bar;

a plurality of expandable spokes secured to the support bar such that each of the plurality of expandable spokes extends radially outward from the support bar, wherein the support bar comprises:

a first hub that extends axially beyond the plurality of expandable spokes in a first direction; and a second hub that extends axially beyond the plurality of expandable spokes in a second direction;

a plurality of drum segments secured to the plurality of expandable spokes circumferentially around the support bar; and a plurality of mechanical actuators secured between the support bar and the plurality of drum segments, wherein the plurality of mechanical actuators is configured to selectively:

extend to facilitate moving the plurality of drum segments away from the support bar and, thus, engaging the plurality of drum segments with a coil of flexible pipe; and retract to facilitate moving the plurality of drum segments toward the support bar and, thus, disengaging the plurality of drum segments from the coil of flexible pipe.

2. The pipe drum assembly of claim 1, comprising a plurality of spoke frames, wherein each of the plurality of spoke frames is secured between adjacent expandable spokes of the plurality of expandable spokes.

3. The pipe drum assembly of claim 2, wherein each of the plurality of spoke frames is secured perpendicular to the support bar.

4. The pipe drum assembly of claim 1, comprising a plurality of fork channels, wherein each of the plurality of fork channels is configured to engage a tine of a forklift to facilitate manipulating the pipe drum assembly via the forklift.

5. The pipe drum assembly of claim 1, comprising a flow distributor configured to distribute hydraulic fluid to the plurality of mechanical actuators.

6. The pipe drum assembly of claim 1, comprising a support bracket disposed around the support bar, wherein the plurality of mechanical actuators is secured between the support bracket and the plurality of drum segments.

7. The pipe drum assembly of claim 6, comprising:

another plurality of expandable spokes secured to the support bar such that each of the another plurality of expandable spokes extends radially outward from the support bar, wherein:

each of the plurality of expandable spokes is secured adjacent to the first hub of the support bar; and each of the another plurality of expandable spokes is secured adjacent to the second hub of the support bar;

another support bracket disposed around the support bar; and another plurality of mechanical actuators, wherein:

the plurality of mechanical actuators is secured between the support bracket and a first end of the plurality of drum segments;

the another plurality of mechanical actuators is secured between the another support bracket and a second end of the plurality of drum segments; and the another plurality of mechanical actuators is configured to selectively:

extend to facilitate moving the plurality of drum segments away from the support bar and, thus, engaging the plurality of drum segments with the coil of flexible pipe; and retract to facilitate moving the plurality of drum segments toward the support bar and, thus, disengaging the plurality of drum segments from the coil of flexible pipe.

8. The pipe drum assembly of claim 7, comprising another mechanical actuator secured between the support bracket and the another support bracket, wherein:

the plurality of mechanical actuators and the another plurality of mechanical actuators are configured to:

extend to facilitate moving the plurality of drum segments away from the support bar a first amount; and retract to facilitate moving the plurality of drum segments toward the support bar the first amount; and the another mechanical actuator is configured to:

extend to facilitate moving the support bracket and the another support bracket away from one another and, thus, moving the plurality of drum segments away from the support bar a second amount; and retract to facilitate moving the support bracket and the another support bracket toward one another and, thus, moving the plurality of drum segments toward the support bar the second amount.

9. The pipe drum assembly of claim 1, wherein:

the first hub comprises a first hub shaft and is configured to fit within a first hub opening on a pipe deployment device to enable the pipe drum assembly to rotate on the pipe deployment device; and the second hub comprises a second hub shaft and is configured to fit within a second hub opening on the pipe deployment device to enable the pipe drum assembly to rotate on the pipe deployment device.

10. The pipe drum assembly of claim 9, comprising:

a first hub spacer disposed around the first hub shaft of the first hub, wherein the first hub spacer is configured to block expandable spokes of the plurality of expandable spokes that are secured adjacent to the first hub from contacting stationary components of the pipe deployment device; and a second hub spacer disposed around the second hub shaft of the second hub, wherein the second hub spacer is configured to block expandable spokes of the plurality of expandable spokes that are secured adjacent to the second hub from contacting stationary components of the pipe deployment device.

11. A method of using a pipe drum assembly, comprising:

inserting the pipe drum assembly into an interior channel of a coil of flexible pipe while a plurality of drum segments of the pipe drum assembly is retracted toward a support bar of the pipe drum assembly, wherein the plurality of drum segments is secured circumferentially around the support bar via a plurality of expandable spokes of the pipe drum assembly;

extending the plurality of drum segments away from the support bar such that the plurality of drum segments engages the coil of flexible pipe to facilitate tying rotation of the pipe drum assembly with rotation of the coil of flexible pipe at least in part by extending one or more mechanical actuators of the pipe drum assembly;

loading the pipe drum assembly on a pipe deployment device such that a first hub at a first axial end of the support bar is disposed within a first hub opening on the pipe deployment device and a second hub at a second axial end of the support bar is disposed within a second hub opening on the pipe deployment device; and rotating the pipe drum assembly on the pipe deployment device to facilitate deploying flexible pipe from the coil of flexible pipe.

12. The method of claim 11, comprising, after the flexible pipe is deployed from the coil of flexible pipe:

retracting the plurality of drum segments toward the support bar such that the plurality of drum segments disengage from the coil of flexible pipe at least in part by retracting the one or more mechanical actuators;

withdrawing the pipe drum assembly from the interior channel of the coil of flexible pipe while the plurality of drum segments is retracted toward the support bar;

inserting the pipe drum assembly into another interior channel of another coil of flexible pipe while the plurality of drum segments is retracted toward the support bar;

extending the plurality of drum segments away from the support bar such that the plurality of drum segments engages the another coil of flexible pipe to facilitate tying rotation of the pipe drum assembly with rotation of the another coil of flexible pipe at least in part by extending the one or more mechanical actuators; and rotating the pipe drum assembly on the pipe deployment device to facilitate deploying other flexible pipe from the another coil of flexible pipe.

13. The method of claim 11, wherein loading the pipe drum assembly on the pipe deployment device comprises:

manipulating the pipe drum assembly using a forklift engaged with fork channels in the pipe drum assembly;

manipulating the pipe drum assembly using a crane secured to the first hub and the second hub of the pipe drum assembly or to pad eyes of the pipe drum assembly; or both.

14. The method of claim 11, wherein the pipe drum assembly comprises a plurality of spoke frames each secured between adjacent expandable spokes of the plurality of expandable spokes perpendicular to the support bar.

15. The method of claim 11, wherein extending the plurality of drum segments away from the support bar comprises:

extending a first plurality of mechanical actuators of the pipe drum assembly that is secured between the support bar and a first end of plurality of drum segments and extending a second plurality of mechanical actuators that is secured between the support bar and a second end of the plurality of drum segments to extend the plurality of drum segments away from the support bar a first amount; and extending another mechanical actuator of the pipe drum assembly that is secured to a first support bracket and a second support bracket of the pipe drum assembly that are each slidably disposed around the support bar to extend the plurality of drum segments away from the support bar a second amount, wherein:

the first support bracket is pivotably secured to the first end of the plurality of drum segments via the first plurality of mechanical actuators; and the second support bracket is pivotably secured to the second end of the plurality of drum segments via the second plurality of mechanical actuators.

16. The method of claim 15, wherein extending the plurality of drum segments away from the support bar comprises distributing hydraulic fluid to the first plurality of mechanical actuators, the second plurality of mechanical actuators, and the another mechanical actuator of the pipe drum assembly.

17. A pipe drum assembly, comprising:

a support bar;

a plurality of expandable spokes secured to the support bar such that each of the plurality of expandable spokes extends radially outward from the support bar, wherein the support bar comprises:

a first hub that extends axially beyond the plurality of expandable spokes in a first direction; and a second hub that extends axially beyond the plurality of expandable spokes in a second direction;

a plurality of drum segments secured to the plurality of expandable spokes circumferentially around the support bar;

a support bracket slidably disposed around the support bar and pivotably secured to the plurality of drum segments; and a mechanical actuator secured to the support bracket, wherein the mechanical actuators is configured to selectively:

extend to facilitate moving the plurality of drum segments away from the support bar and, thus, engaging the plurality of drum segments with a coil of flexible pipe; and retract to facilitate moving the plurality of drum segments toward the support bar and, thus, disengaging the plurality of drum segments from the coil of flexible pipe.

18. The pipe drum assembly of claim 17, comprising another support bracket slidably disposed around the support bar, wherein:

the support bracket is pivotably secured to a first end of the plurality of drum segments;

the another support bracket is pivotably secured to a second end of the plurality of drum segments; and the mechanical actuator is secured between the support bracket and the another support bracket, wherein the mechanical actuator is configured to selectively:

extend to facilitate moving the support bracket and the another support bracket away from one another and, thus, moving the plurality of drum segments away from the support bar; and retract to facilitate moving the support bracket and the another support bracket toward one another and, thus, moving the plurality of drum segments toward the support bar.

19. The pipe drum assembly of claim 18, comprising:

a first plurality of other mechanical actuators pivotably secured between the support bracket and the first end of the plurality of drum segments; and a second plurality of other mechanical actuators pivotably secured between the another support bracket and the second end of the plurality of drum segments, wherein:

the first plurality of other mechanical actuators and the second plurality of other mechanical actuators are configured to:

extend to facilitate moving the plurality of drum segments away from the support bar a first amount; and retract to facilitate moving the plurality of drum segments toward the support bar the first amount; and the mechanical actuator is configured to:

extend to facilitate moving the plurality of drum segments away from the support bar a second amount; and retract to facilitate moving the plurality of drum segments toward the support bar the second amount.

20. The pipe drum assembly of claim 17, wherein:

the first hub comprises a first hub shaft and is configured to fit within a first hub opening on a pipe deployment device to enable the pipe drum assembly to rotate on the pipe deployment device; and the second hub comprises a second hub shaft and is configured to fit within a second hub opening on the pipe deployment device to enable the pipe drum assembly to rotate on the pipe deployment device.

* * * * *